US008736507B2

(12) United States Patent
Ohno

(10) Patent No.: US 8,736,507 B2
(45) Date of Patent: May 27, 2014

(54) ANTENNA APPARATUS PROVIDED WITH DIPOLE ANTENNA AND PARASITIC ELEMENT PAIRS AS ARRANGED AT INTERVALS

(75) Inventor: Takeshi Ohno, Osaka (JP)

(73) Assignee: Panasonic Corporation, Osaka (JP)

( * ) Notice: Subject to any disclaimer, the term of this patent is extended or adjusted under 35 U.S.C. 154(b) by 162 days.

(21) Appl. No.: 13/519,708

(22) PCT Filed: Oct. 21, 2011

(86) PCT No.: PCT/JP2011/005910

§ 371 (c)(1),
(2), (4) Date: Jun. 28, 2012

(87) PCT Pub. No.: WO2012/053223

PCT Pub. Date: Apr. 26, 2012

(65) Prior Publication Data

US 2012/0293387 A1 Nov. 22, 2012

(30) Foreign Application Priority Data

Oct. 22, 2010 (JP) ..... 2010-236995

(51) Int. Cl.
*H01Q 19/30* (2006.01)
*H01Q 9/28* (2006.01)

(52) U.S. Cl.
CPC ..... *H01Q 19/30* (2013.01); *H01Q 9/285* (2013.01)
USPC ..... 343/818; 343/795

(58) Field of Classification Search
CPC ..... H01Q 9/285; H01Q 19/30; H01Q 9/16
USPC ..... 343/700 MS, 795, 817, 818, 819
See application file for complete search history.

(56) References Cited

U.S. PATENT DOCUMENTS

2003/0160730 A1* 8/2003 Alsliety ..... 343/818
2003/0231138 A1* 12/2003 Weinstein ..... 343/795
2007/0063056 A1* 3/2007 Gaucher et al. ..... 235/492
2008/0272976 A1 11/2008 Kitamori et al.

(Continued)

FOREIGN PATENT DOCUMENTS

JP 48-66761 9/1973
JP 2-113706 4/1990

(Continued)

OTHER PUBLICATIONS

International Preliminary Report on Patentability and Written Opinion of the International Searching Authority issued May 16, 2013 in International (PCT) Application No. PCT/JP2011/005910.

(Continued)

*Primary Examiner* — Hoanganh Le
(74) *Attorney, Agent, or Firm* — Wenderoth, Lind & Ponack, L.L.P.

(57) ABSTRACT

Parasitic elements of each parasitic element pair have a strip shape, and are formed on a straight line, which is parallel to a longitudinal direction of a printed dipole antenna and is positioned in a radiation direction of radio wave from the printed dipole antenna, so as to have a gap of a predetermined interval. The parasitic element pairs and the dipole antenna are arranged at predetermined intervals so as to oppose to and to be electromagnetically coupled to each other.

11 Claims, 18 Drawing Sheets

(56) References Cited

U.S. PATENT DOCUMENTS

| | | | | |
|---|---|---|---|---|
| 2009/0046019 | A1 | 2/2009 | Sato | |
| 2009/0195460 | A1 | 8/2009 | Kanno | |
| 2009/0207088 | A1 | 8/2009 | Sato et al. | |
| 2009/0295667 | A1* | 12/2009 | Ma et al. | 343/795 |
| 2013/0300624 | A1* | 11/2013 | Fakharzadeh Jahromi | 343/793 |

FOREIGN PATENT DOCUMENTS

| | | |
|---|---|---|
| JP | 7-245525 | 9/1995 |
| JP | 2001-244731 | 9/2001 |
| JP | 2001-284946 | 10/2001 |
| JP | 2003-309417 | 10/2003 |
| JP | 2007-300266 | 11/2007 |
| JP | 2009-194844 | 8/2009 |
| WO | 2007/097282 | 8/2007 |

OTHER PUBLICATIONS

International Search Report issued Jan. 24, 2012 in International (PCT) Application No. PCT/JP2011/005910.

* cited by examiner

ANTENNA APPARATUS PROVIDED WITH DIPOLE ANTENNA AND PARASITIC ELEMENT PAIRS AS ARRANGED AT INTERVALS

TECHNICAL FIELD

The present invention relates to an antenna apparatus including a dipole antenna, and a wireless communication apparatus including the antenna apparatus.

BACKGROUND ART

So far, there have been proposed a variety of antenna apparatuses, which use a basic printed dipole antenna or a printed Yagi antenna having a printed dipole antenna (See Patent Documents 1 to 5, for example). For example, in the Patent Document 1, there is described an antenna apparatus that widens the band of an antenna for horizontal polarization using a dipole antenna element. The antenna apparatus described in the Patent Document 1 is characterized in that a pair of linear parasitic elements are provided on a plane the same as that of the dipole antenna element and in the vicinities of both of end portions of the printed dipole antenna element. In addition, the Patent Document 2 describes a bidirectional antenna that has a printed Yagi antenna and has a bidirectional characteristic in the end-fire direction. The antenna described in the Patent Document 2 is characterized in that two Yagi antennas are provided on one printed board to have a bidirectional directivity as the whole antenna, and excitation elements constituting the printed Yagi antennas are fed in phases opposite to each other.

CITATION LIST

Patent Document

Patent Document 1: Japanese patent laid-open publication No. JP 2001-284946 A.

Patent Document 2: Japanese patent laid-open publication No. 7-245525 A.

Patent Document 3: Specification of U.S. Patent Application Publication No. U.S. 2009/0207088 A1;

Patent Document 4: Specification of U.S. Patent Application No. U.S. 2009/0046019 A1; and Patent Document 5: Specification of U.S. Patent Application No. U.S. 2009/0195460 A1.

SUMMARY OF INVENTION

Technical Problem

The printed Yagi antenna is an end-fire antenna apparatus that can be manufactured easily by using a dielectric substrate, and it has been known that the printed Yagi antenna has a relatively high gain. However, there has been such a problem that a high-gain characteristic cannot be obtained due to a loss in the dielectric substrate when a general printed board such as a glass epoxy board is used as the dielectric substrate for the printed Yagi antenna used in a high-frequency band such as the milliwave band or the microwave band. In addition, there has been such a problem that the size of the antenna apparatus cannot be reduced since the antenna size needs to be enlarged in order to suppress a decrease in gain.

It is an object of the present invention to provide an antenna apparatus capable of solving the above-described problems, having a size smaller than that of the prior art, and having a gain characteristic higher than that of the prior art, and a wireless communication apparatus that has the antenna apparatus.

Solution to the Problem

An antenna apparatus according to the first invention includes:

- a dielectric substrate having first and second surfaces;
- a grounding conductor formed on the first surface;
- a strip conductor formed on the second surface so as to oppose to the grounding conductor to configure a feeder line;
- a dipole antenna that includes first and second feed elements and has an electrical length that is substantially a half of a wavelength of a high-frequency signal transmitted via the feeder line, the first feed element being formed on the second surface and connected to the strip conductor, the second feed element being formed on the first surface and connected to the grounding conductor; and
- a plurality of first parasitic element pairs, each of the first parasitic element pairs including first and second parasitic elements being formed on the second surface.

The first and second parasitic elements of each of the first parasitic element pairs have a strip shape and are formed on a straight line, which is parallel to a longitudinal direction of the dipole antenna and is positioned in a radiation direction of a radio wave from the dipole antenna, so as to have a gap therebetween and so as to be electromagnetically coupled with each other. The dipole antenna and the respective first parasitic element pairs are arranged at predetermined intervals so as to oppose to and to be electromagnetically coupled to each other.

The above-described antenna apparatus, further includes a plurality of third parasitic elements formed in the respective gaps between the first parasitic element pairs, respectively, so that each of the third parasitic elements is electromagnetically coupled to the first parasitic element and is electromagnetically coupled to the second parasitic element.

In addition, in the above-described antenna apparatus, the dipole antenna further includes a fourth parasitic element formed on the first surface so as to oppose to the first feed element, and a fifth parasitic element formed on the second surface so as to oppose to the second feed element. The antenna apparatus further includes a plurality of sixth parasitic elements formed on the first surface so as to oppose to the first parasitic elements, respectively, a plurality of seventh parasitic elements formed on the first surface so as to oppose to the second parasitic elements, respectively, and a plurality of eighth parasitic elements formed on the first surface so as to oppose to the third parasitic elements, respectively.

Further, in the above-described antenna apparatus, the dipole antenna further includes a third parasitic element formed on the first surface so as to oppose to the first feed element, and a fourth parasitic element formed on the second surface so as to oppose to the second feed element. The antenna apparatus further includes a plurality of fifth parasitic elements formed on the first surface so as to oppose to the first parasitic elements, respectively, and a plurality of sixth parasitic elements formed on the first surface so as to oppose to the second parasitic elements, respectively.

Still further, in the above-described antenna apparatus, an electrical length of the first feed element and an electrical length of the second feed element are set to be different from each other.

In addition, in the above-described antenna apparatus, an electrical length of the first feed element and an electrical length of the second feed element are set substantially equal to each other.

Further, in the above-described antenna apparatus, the antenna apparatus further includes at least one second parasitic element pair including two parasitic elements that are formed on one of the first and the second surfaces so as to operate as a reflector. The two parasitic elements have a strip shape and are formed on a straight line, which is parallel to the longitudinal direction of the dipole antenna and is positioned in a direction opposite to the radiation direction of the radio wave from the dipole antenna, so as to oppose to and electromagnetically coupled to the dipole antenna.

Still further, in the above-described antenna apparatus, the feeder line is an unbalanced line.

In addition, in the above-described antenna apparatus, the electrical length of each of the first parasitic elements and the electrical length of each of the second parasitic elements are set to an electrical length that is substantially one-fourth of the wavelength.

Further, in the above-described antenna apparatus, the interval is set to an interval that is substantially equal to or smaller than one-eights of the wavelength.

A wireless communication apparatus according to the second invention includes the above-described antenna apparatus.

Advantageous Effects of Invention

According to the antenna apparatus and the wireless communication apparatus of the present invention, there are provided a plurality of first parasitic element pairs, each of the first parasitic element pairs including first and second parasitic elements formed on the second surface. In this case, the first and second parasitic elements of each of the first parasitic element pairs have a strip shape and are formed on a straight line, which is parallel to a longitudinal direction of the dipole antenna and is positioned in a radiation direction of a radio wave from the dipole antenna, so as to have a gap therebetween and so as to be electromagnetically coupled with each other. In addition, the dipole antenna and the respective first parasitic element pairs are arranged at predetermined intervals so as to oppose to and to be electromagnetically coupled to each other. Therefore, it is possible to provide an antenna apparatus and a wireless communication apparatus each having a size smaller than that of the prior art and having a gain characteristic higher than that of the prior art.

DESCRIPTION OF EMBODIMENTS

Figure 1:
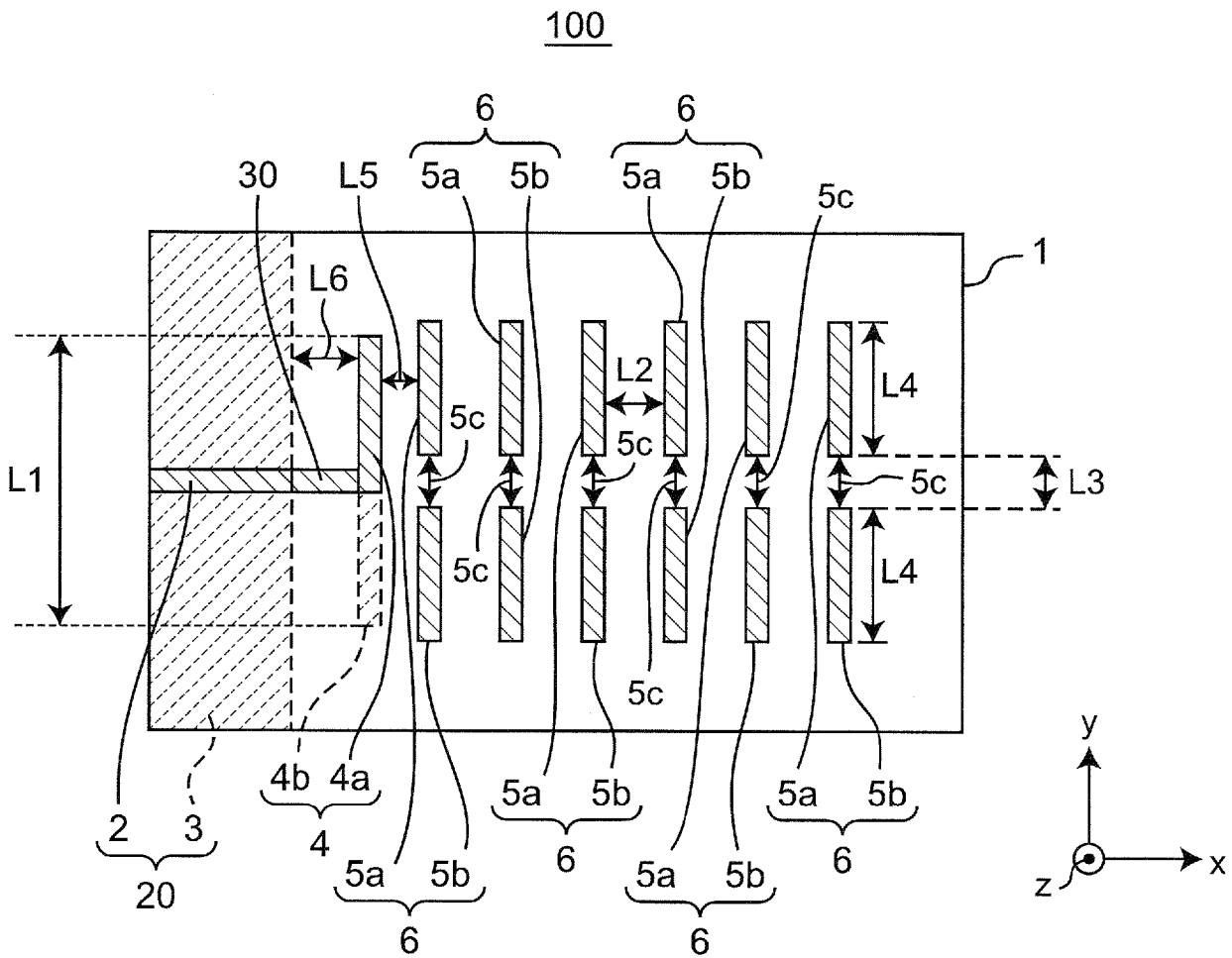
FIG. 1 is a top view of an antenna apparatus 100 according to a first embodiment of the present invention.

Preferred embodiments of the present invention will be described hereinafter with reference to the drawings. In the preferred embodiments, components similar to each other are denoted by the same reference numerals.

First Embodiment

Figure 2:
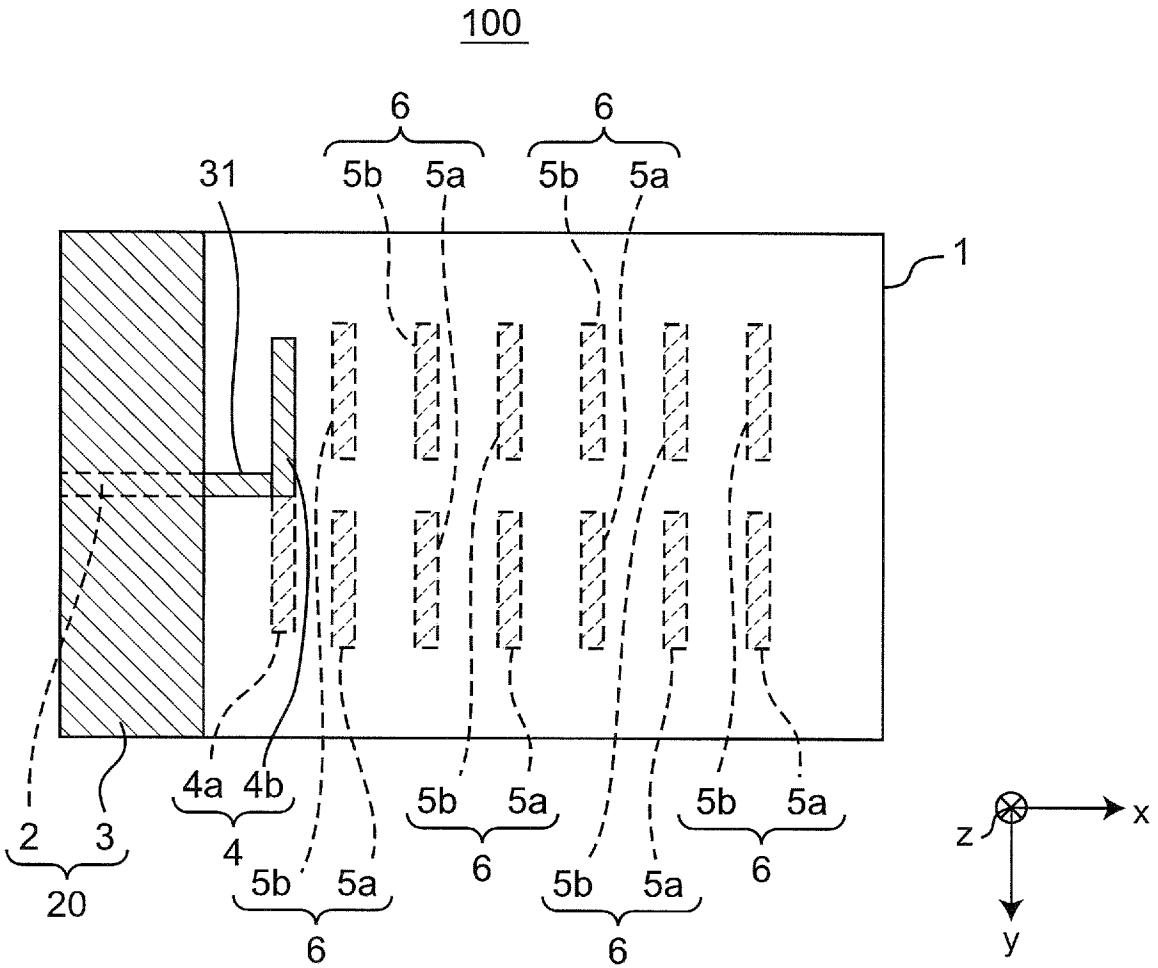
FIG. 2 is a reverse side view of the antenna apparatus 100 of FIG. 1.

FIG. 1 is a top view of an antenna apparatus 100 according to a first embodiment of the present invention, and FIG. 2 is a reverse side view of the antenna apparatus 100 of FIG. 1. The antenna apparatus 100 of the present embodiment is an end-fire antenna apparatus for a wireless communication apparatus to perform wireless communications in a high-frequency band such as the microwave band or the milliwave band.

Referring to FIGS. 1 and 2, the antenna apparatus 100 is configured to include a dielectric substrate 1, strip conductors 2, 30 and 31, feed elements 4*a* and 4*b*, and six parasitic element pairs 6 each of which includes parasitic elements 5*a* and 5*b*. It is noted that an xyz coordinate system is defined as shown in FIG. 1 in the present embodiment and the following embodiments.

As described later in detail, the antenna apparatus 100 of the present embodiment is configured to include the following:

(a) the dielectric substrate 1 having a first surface that is a top surface, and a second surface that is a reverse surface;

(b) a grounding conductor 3 formed on the first surface;

(c) the strip conductor 2 formed on the second surface so as to oppose to the grounding conductor 3 to configure a feeder line 20;

(d) a dipole antenna 4, which includes the feed elements 4*a* and 4*b* and has an electrical length L1 that is substantially a half of the wavelength λ of a high-frequency signal transmitted via the feeder line 20, where the feed element 4*a* is formed on the second surface and is connected to the strip conductor 2, and the feed element 4*b* is formed on the first surface and is connected to the grounding conductor 3; and (e) a plurality of parasitic element pairs 6 each having parasitic elements 5*a* and 5*b* formed on the second surface.

In this case, the antenna apparatus 100 is characterized in that the parasitic elements 5*a* and 5*b* of each of the parasitic element pairs 6 have a strip shape and are formed on a straight line, which is parallel to a longitudinal direction (y-axis direction) of the dipole antenna 4 and is positioned in a radiation direction of a radio wave from the dipole antenna 4, so as to have a gap 5*c* between respective parasitic elements 5*a* and 5*b* and so as to be electromagnetically coupled with each other. The dipole antenna 4 and the parasitic element pair 6 located nearest to the dipole antenna 4 are arranged at a predetermined interval L5 so as to oppose to and to be electromagnetically coupled to each other, and the parasitic element pairs 6 are arranged at predetermined intervals L2 so as to oppose to and to be electromagnetically coupled to each other.

Referring to FIG. 1, the dielectric substrate 1 is made of a glass epoxy board, for example. In addition, the strip conductors 2 and 30, the feed element 4*a* and the feed element pairs 6 are formed on the top surface of the dielectric substrate 1. On the other hand, the grounding conductor 3, the strip conductor 31 and the feed element 4*b* are formed on the reverse surface of the dielectric substrate 1. Further, the grounding conductor 3 is formed at the left end portion of the dielectric substrate 1 of FIG. 1. The strip conductor 2 is formed so as to oppose to the grounding conductor 3 and to extend in a positive x-axis direction from the left end portion of the dielectric substrate 1. In addition, the strip conductor 30 has an electrical length L6 and has one end connected to the right end portion of the strip conductor 2 of FIG. 1 and another end. The strip conductor 30 is formed to extend in the x-axis direction. Further, the feed element 4*a* has a strip shape extending in a y-axis direction, and has one end connected to another end of the strip conductor 30 and another end that is an open end.

Referring to FIG. 2, the strip conductor 31 has one end connected to the grounding conductor 3 and another end connected to one end of the feed element 4*b*, and is formed to oppose to the strip conductor 30. In addition, the feed element 4*b* has a strip shape extending in the y-axis direction, and has one end connected to another end of strip conductor 31 and another end that is an open end.

In this case, referring to FIGS. 1 and 2, the grounding conductor 3 and the strip conductor 2 sandwiching the dielectric substrate 1 therebetween constitute a microstrip line, and are used as the feeder line 20. In addition, the feed elements 4*a* and 4*b* operate as a half-wavelength printed dipole antenna 4 (referred to as a dipole antenna 4 hereinafter) having an electrical length L1 from the open end of the feed element 4*a* to the open end of the feed element 4*b*.

In each of the parasitic element pairs 6 of FIG. 1, each of the parasitic elements 5*a* and 5*b* has a strip shape having an electrical length L4. The parasitic elements 5*a* and 5*b* of each of the parasitic element pairs 6 are formed on a straight line parallel to the y axis (i.e., the longitudinal direction of the dipole antenna 4) so as to have a gap 5*c* of a predetermined interval L3. Further, the six parasitic element pairs 6 are formed in the radiation direction (that is the positive direction of the x axis, and is also referred to as an end-fire direction hereinafter) of a radio wave from the dipole antenna 4 so as to oppose to each other at predetermined intervals L2. In addition, an interval between the parasitic element pair 6 located nearest to the dipole antenna 4 and the dipole antenna 4 is set to an interval L5.

In this case, the electrical length L1 of the dipole antenna 4 is set to be substantially equal to a half of the wavelength λ of the high-frequency signal fed to the feeder line 20. In addition, the electrical lengths of the feed elements 4*a* and 4*b* are set to be substantially equal to each other. Further, the interval L2 is set so that adjacent parasitic element pairs 6 are electromagnetically coupled to each other. Still further, the interval L3 is set to, for example, λ/25 so that the parasitic elements 5*a* and 5*b* in each parasitic element pair 6 are electromagnetically coupled to each other. In addition, the electrical length L4 is set to an electrical length substantially equal to λ/4. Further, the interval L5 is set so that the parasitic element pair 6 located nearest to the dipole antenna 4 and the dipole antenna 4 are electromagnetically coupled to each other, and is preferably set to a value equal to the interval L2. The electrical length L6 is set to be equal to the interval L2, for example.

Referring to FIGS. 1 and 2, the high-frequency signal from a high-frequency circuit that outputs the high-frequency signal having frequency components within a high-frequency band such as the microwave band or the milliwave band is transmitted via a transmission line including the feeder line 20 and the strip conductors 30 and 31 sandwiching the dielectric substrate 1 therebetween, fed to the dipole antenna 4, and radiated from the dipole antenna 4. On the other hand, at each parasitic element pairs 6, an electromagnetically coupled intense electric field is generated at the gap 5*c* between the parasitic elements 5*a* and 5*b*. Then, the parasitic elements 5*a* and 5*b* resonate. Therefore, the radio wave radiated from the dipole antenna 4 is guided on the surface of the dielectric substrate 1 along the gaps 5*c* of the respective parasitic element pairs 6, and is radiated in the end-fire direction. In this case, radio waves are aligned in phase, and an equiphase wave plane is generated at the end portion (right end portion of the dielectric substrate 1 of FIG. 1) in the end-fire direction of the dielectric substrate 1. As described above, is the parasitic elements 5*a* and 5*b* operate as a wave director.

Next, results of three-dimensional electromagnetic analysis of the antenna apparatus 100 of FIG. 1 and an antenna apparatus 300 of a comparative example will be described.

Figure 17:
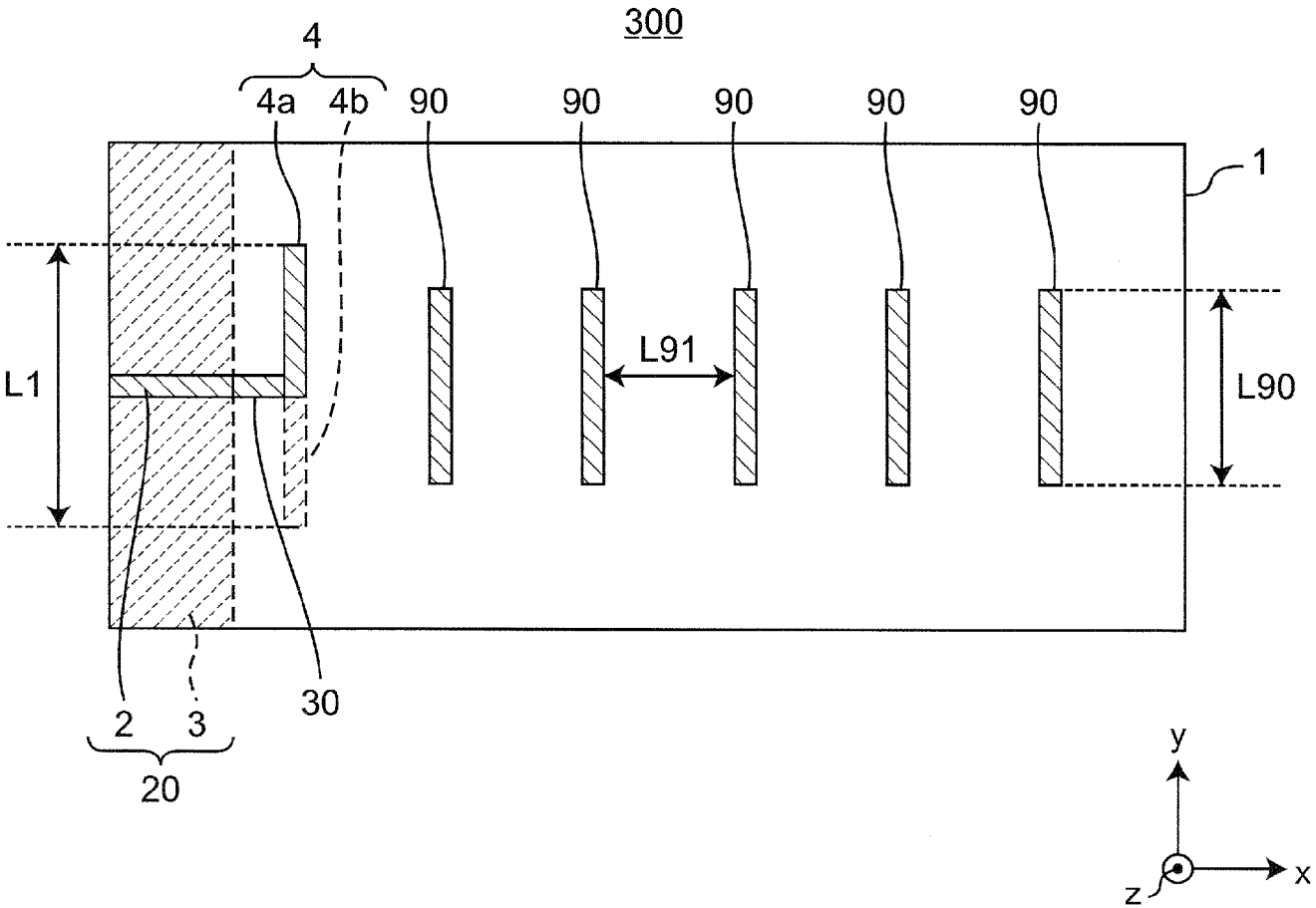
FIG. 17 is a top view of an antenna apparatus 300 according to a comparative example.
Figure 18:
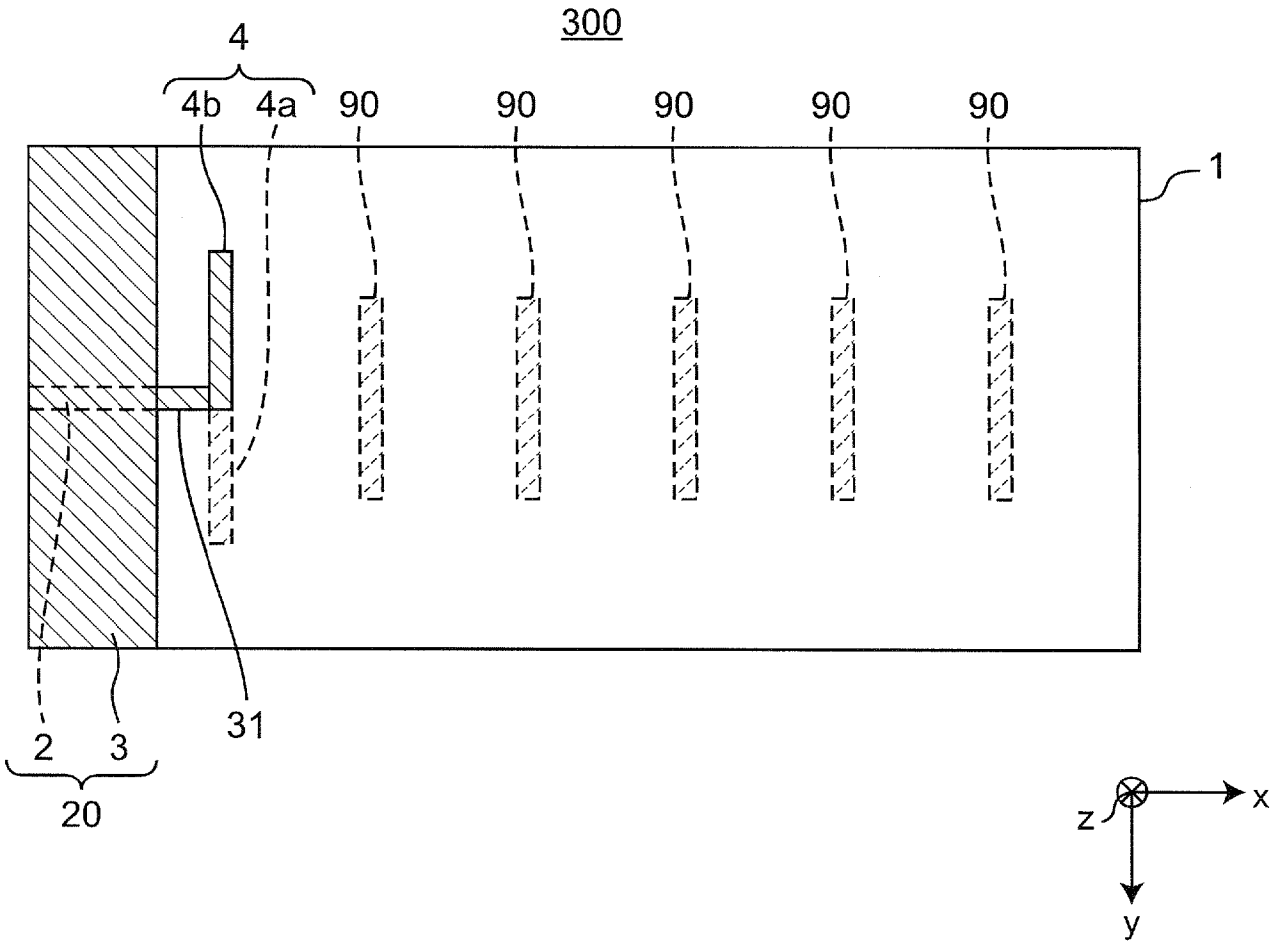
FIG. 18 is a reverse side view of the antenna apparatus 300 of FIG. 17.

FIG. 17 is a top view of the antenna apparatus 300 of the comparative example, and FIG. 18 is a reverse side view of the antenna apparatus 300 of FIG. 17. The antenna apparatus 300 of the comparative example is a printed Yagi antenna. Referring to FIGS. 17 and 18, the antenna apparatus 300 is configured to include a dielectric substrate 1, strip conductors 2, 30 and 31, feed elements 4*a* and 4*b*, and five parasitic elements 90. In this case, referring to FIGS. 17 and 18, the strip conductors 2, 30 and 31, and the feed elements 4*a* and 4*b* are formed on the dielectric substrate 1 in manners similar to those of the strip conductors 2, 30 and 31, and the feed elements 4*a* and 4*b* of the antenna apparatuses 100 of the first embodiment.

In addition, referring to FIG. 17, each of the parasitic elements 90 has a strip shape of an electrical length L90 extending in the y-axis direction, and the parasitic elements 90 are formed at predetermined intervals L91 in the radiation direction of the radio wave from the dipole antenna 4. In this case, the electrical length L90 of each parasitic element 190 is substantially set to λ/2, and the interval L91 is substantially set to λ/4.

Referring to FIGS. 17 and 18, the high-frequency signal from the high-frequency circuit that outputs the high-frequency signal having frequency components in a high-frequency band such as the microwave band or the milliwave band is fed to the dipole antenna 4 and radiated in a manner similar to that of the antenna apparatus 100 of the first embodiment. Then, the radio wave radiated from the dipole antenna 4 is guided by the parasitic elements 90 that operate as a wave director and is radiated in the end-fire direction from the right end portion of the dielectric substrate 1 of FIG. 17.

Figure 3:
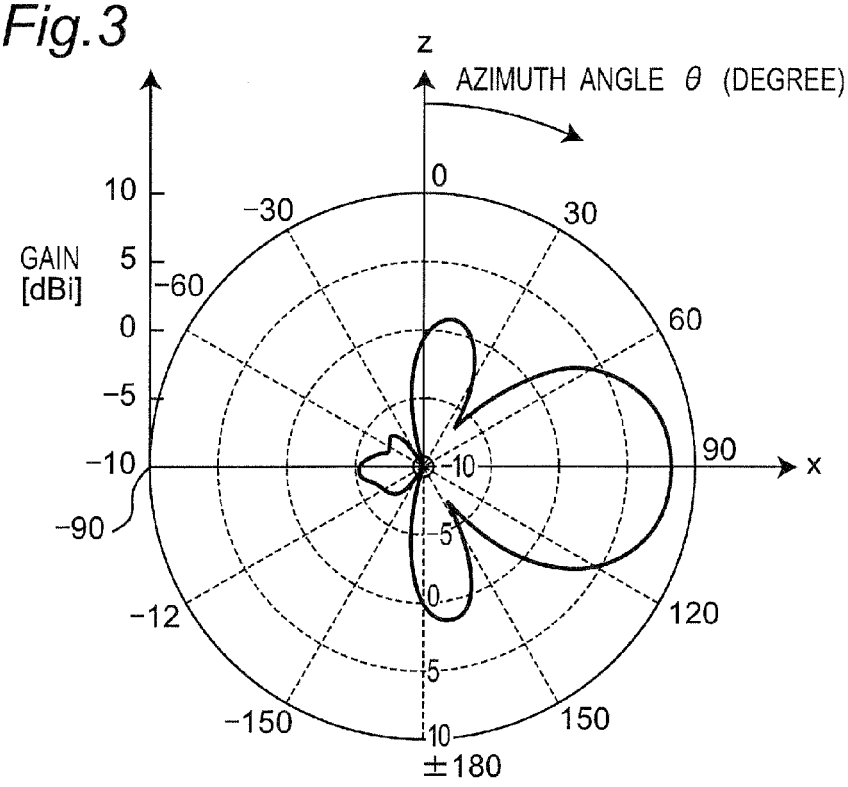
FIG. 3 is a graph showing a radiation pattern on an xz plane of the antenna apparatus 100 of FIG. 1.
Figure 4:
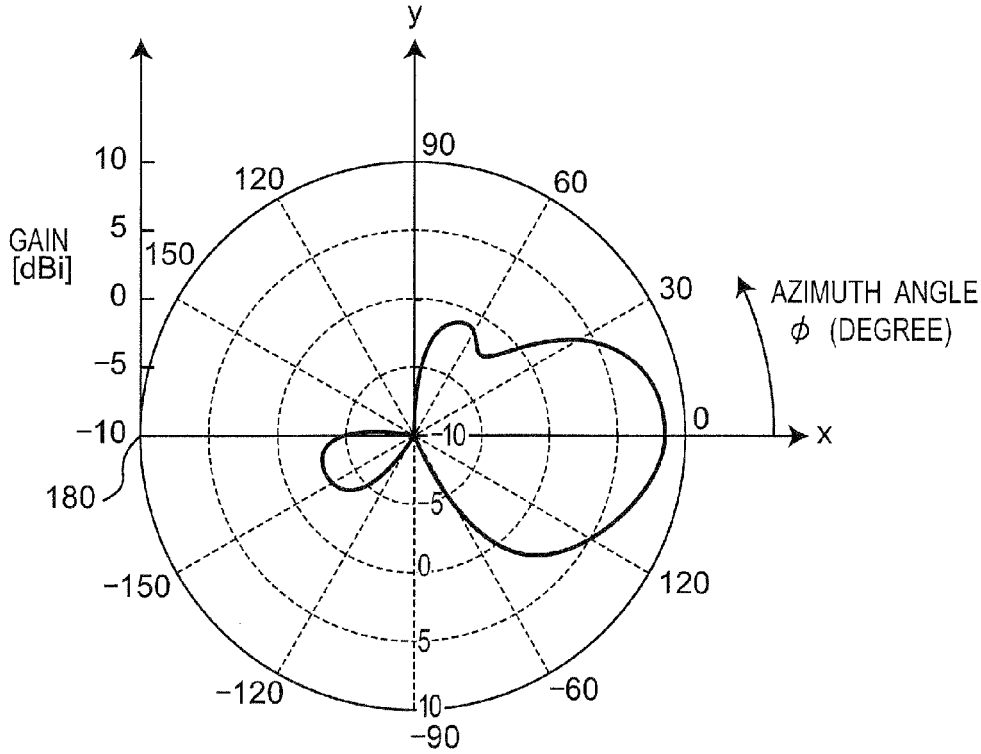
FIG. 4 is a graph showing a radiation pattern on an xy plane of the antenna apparatus 100 of FIG. 1.
Figure 19:
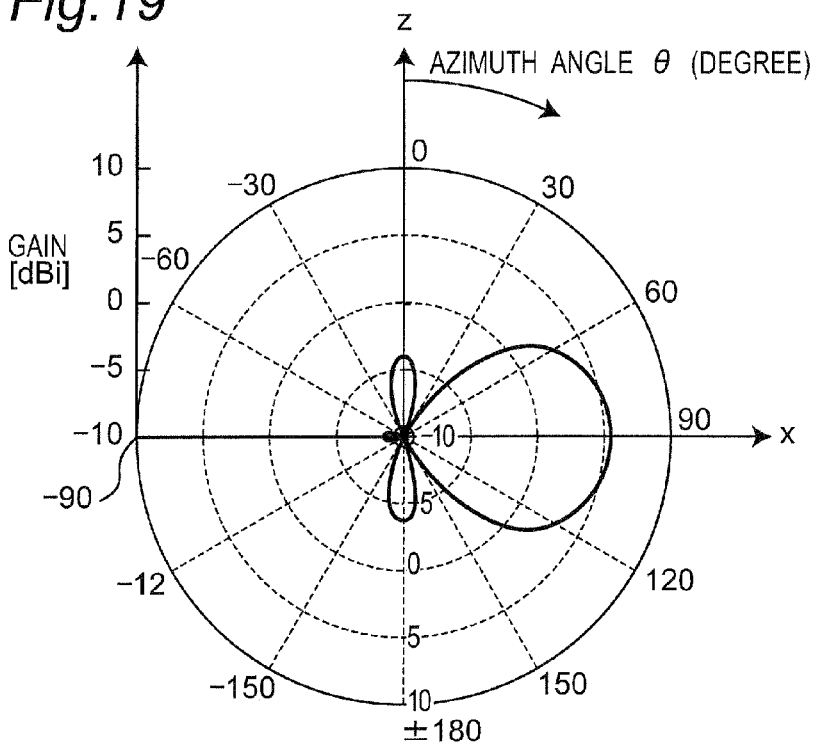
FIG. 19 is a graph showing a radiation pattern on the xz plane of the antenna apparatus 300 of FIG. 17.
Figure 20:
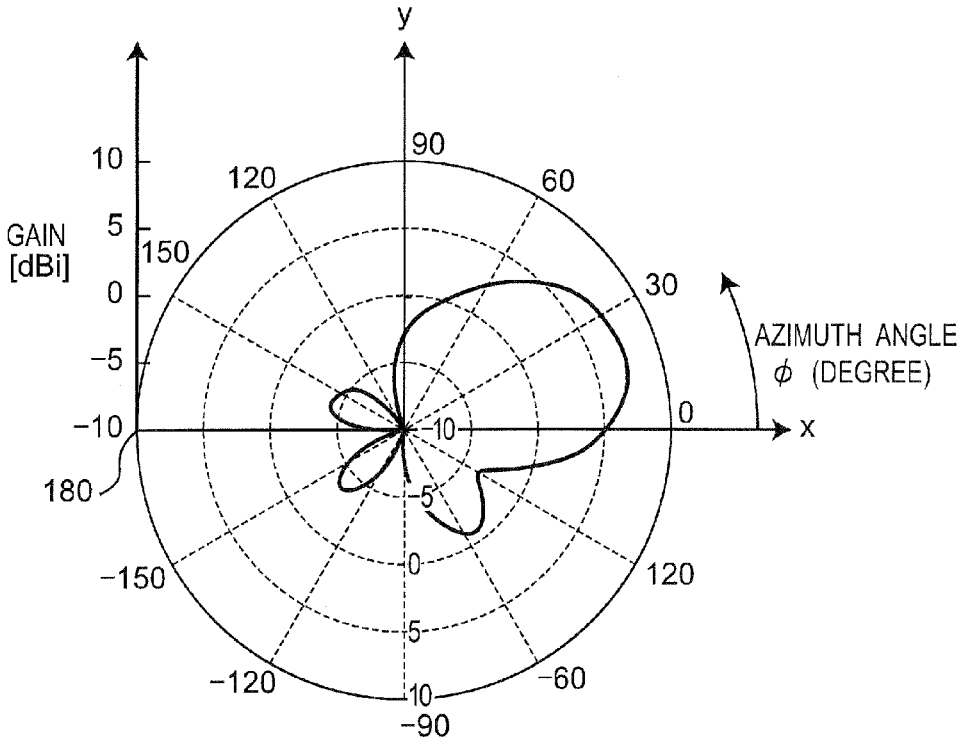
FIG. 20 is a graph showing a radiation pattern on the xy plane of the antenna apparatus 300 of FIG. 17.

FIGS. 3 and 4 are graphs showing radiation patterns on the xz plane and the xy plane, respectively, of the antenna apparatus 100 of FIG. 1. FIGS. 19 and 20 are graphs showing radiation patterns on the xz plane and the xy plane, respectively, of the antenna apparatus 300 of FIG. 17. In FIGS. 3, 4, 19 and 20, a glass epoxy board was used as the dielectric substrate 1, and the frequency of the high-frequency signal fed to the dipole antenna 4 was set to 60 GHz. In addition, referring to FIGS. 3 and 4, the interval L2 between the parasitic element pairs 6 was set to λ/8, the interval L3 was set to λ/25, and each of the interval L5 and the electrical length L6 was set to a value equal to the interval L3.

As shown in FIGS. 19 and 20, a main beam thereof is formed in the end-fire direction in the antenna apparatus 300 of the comparative example. It is expected that a theoretical peak gain is 9.1 dBi in the antenna apparatus 300, however, an actual peak gain decreases to 7.6 dBi, and this means that a high-gain characteristic is not obtained. This is presumably attributed to the fact that the radio wave in the high-frequency band such as the milliwave band or the microwave band are strongly affected by the dielectric loss in the dielectric substrate 1 than the radio wave in the lower frequency band. In addition, in the past, it has been required to increase the antenna size in order to overcome such a gain decrease. On the other hand, as shown in FIGS. 3 and 4, in the case of the antenna apparatus 100 of the present embodiment, a radiation pattern of a shape almost similar to that of the antenna apparatus 300 of the comparative example can be obtained, and the peak gain has increased up to 8.3 dBi.

Figure 5:
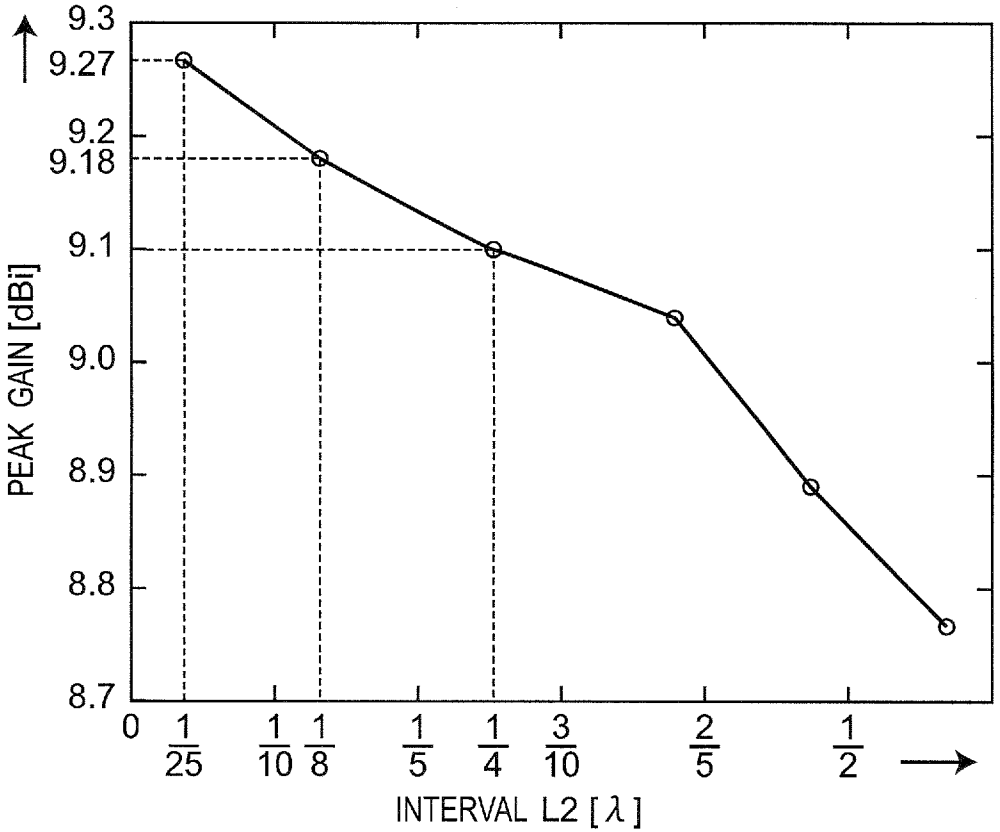
FIG. 5 is a graph showing a relation between an interval L2, at which dielectric element pairs 6 of the antenna apparatus 100 of FIG. 1 are provided, and a peak gain.

FIG. 5 is a graph showing a relation between the interval L2, at which the dielectric element pairs 6 of the antenna apparatus 100 of FIG. 1 are provided, and a peak gain. As shown in FIG. 5, the smaller the interval L2 becomes, the larger the peak gain becomes. In particular, the peak gain is improved even when the interval L2 is smaller than the interval L91 (λ/4) between the parasitic elements 109 in the antenna apparatus 300 of the comparative example. Therefore, the interval L2 is preferably set to a value smaller than λ/8. It is more preferably to set the interval L2 to a minimum value (e.g., 100 μm) achievable by the manufacturing processes of the antenna apparatus 100. In this case, the width of the parasitic elements 5*a* and 5*b* is set to a value substantially equal to the interval L2.

According to the present embodiment, as described above, an electromagnetically coupled intense electric field is generated at the gap 5*c* between the parasitic elements 5*a* and 5*b* in each parasitic element pair 6. Therefore, the radio wave radiated from the dipole antenna 4 is guided on the surface of the dielectric substrate 1 along the gaps 5*c* of the respective parasitic element pairs 6, and is radiated in the end-fire direction. In particular, by setting the interval L2 as small as possible as described above, the parasitic element pairs 6 are intensely electromagnetically coupled to each other via a free space on the surface of the dielectric substrate 1, and the density of the lines of electric force in the dielectric substrate 1 can be decreased. Therefore, the influence of the dielectric loss in the dielectric substrate 1 can be reduced. Therefore, it is possible to obtain a gain characteristic higher than that of the antenna apparatus 300 of the comparative example.

In addition, according to the present embodiment, by changing the interval L3, only the beam width on the horizontal plane (xy plane) can be changed without changing the beam width on the vertical plane (xz plane). Concretely speaking, the width of the equiphase wave plane of the horizontal plane generated at the end portion in the end-fire direction of the dielectric substrate 1 is widened as the interval L3 is set larger, and therefore, the antenna size in the horizontal direction is increased. Therefore, the width of the horizontal beam is decreased, and the gain is increased. Namely, according to the present embodiment, by changing the interval L3 in a manner different from that of the general Yagi antenna in which the interval L91 between the parasitic elements 190 is set to λ/4, the beam width on the horizontal plane can be changed to be independent on the beam width on the vertical plane. In addition, according to the present embodiment, all of the parasitic element pairs 6 have the shapes the same as each other, and therefore, the interval L3 can be designed relatively easily.

Further, the number of the parasitic element pairs 6 is six in the present embodiment, however, the present invention is not limited to this. By changing the number of the parasitic element pairs 6, the beam width on the vertical plane (xz plane) and the beam width on the horizontal plane can be changed. Generally speaking, the beam width on the vertical plane can be narrowed as the antenna size in the waveguide direction is increased in the end-fire antenna apparatus. In the case of the present embodiment, when the number of the parasitic element pairs 6 is increased, the antenna size in the waveguide direction is increased, and the beam width on the vertical plane can be narrowed.

As described above, according to the antenna apparatus 100 of the present embodiment, a gain characteristic higher than that of the prior art can be obtained. In addition, by setting the interval L2 smaller than, for example, λ/8, an antenna apparatus 100 having a size smaller than that of the prior art can be realized. Still further, since the equiphase wave plane is generated at the end portion of the dielectric substrate 1, the beam width on the vertical plane and the beam width on the horizontal plane can be narrowed than those of the prior art.

Second Embodiment

As described above, according to the antenna apparatus 100 of the first embodiment, the beam width on the horizontal plane is reduced by widening the interval L3 of the gap 5*c* between the parasitic elements 5*a* and 5*b*, and this led to the improved the antenna gain. However, when the interval L3 is set larger than a predetermined value, the degree of electromagnetic coupling between the parasitic elements 5*a* and 5*b* is reduced, and the antenna gain decreases. In the present embodiment, a parasitic element 7 is further provided at each of the gaps 5*c* in order to suppress such a decrease in the antenna gain.

Figure 6:
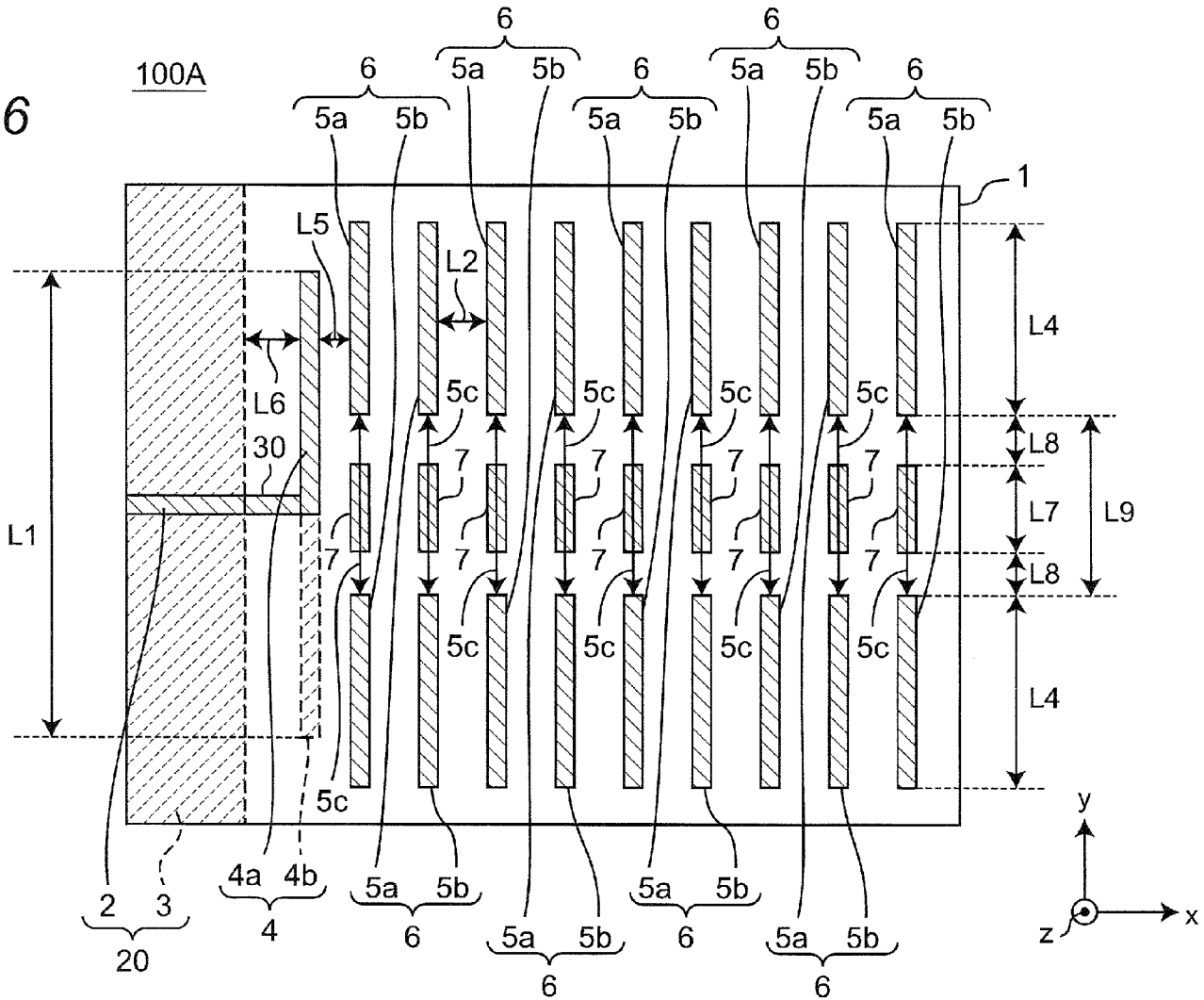
FIG. 6 is a top view of an antenna apparatus 100A according to a second embodiment of the present invention.
Figure 7:
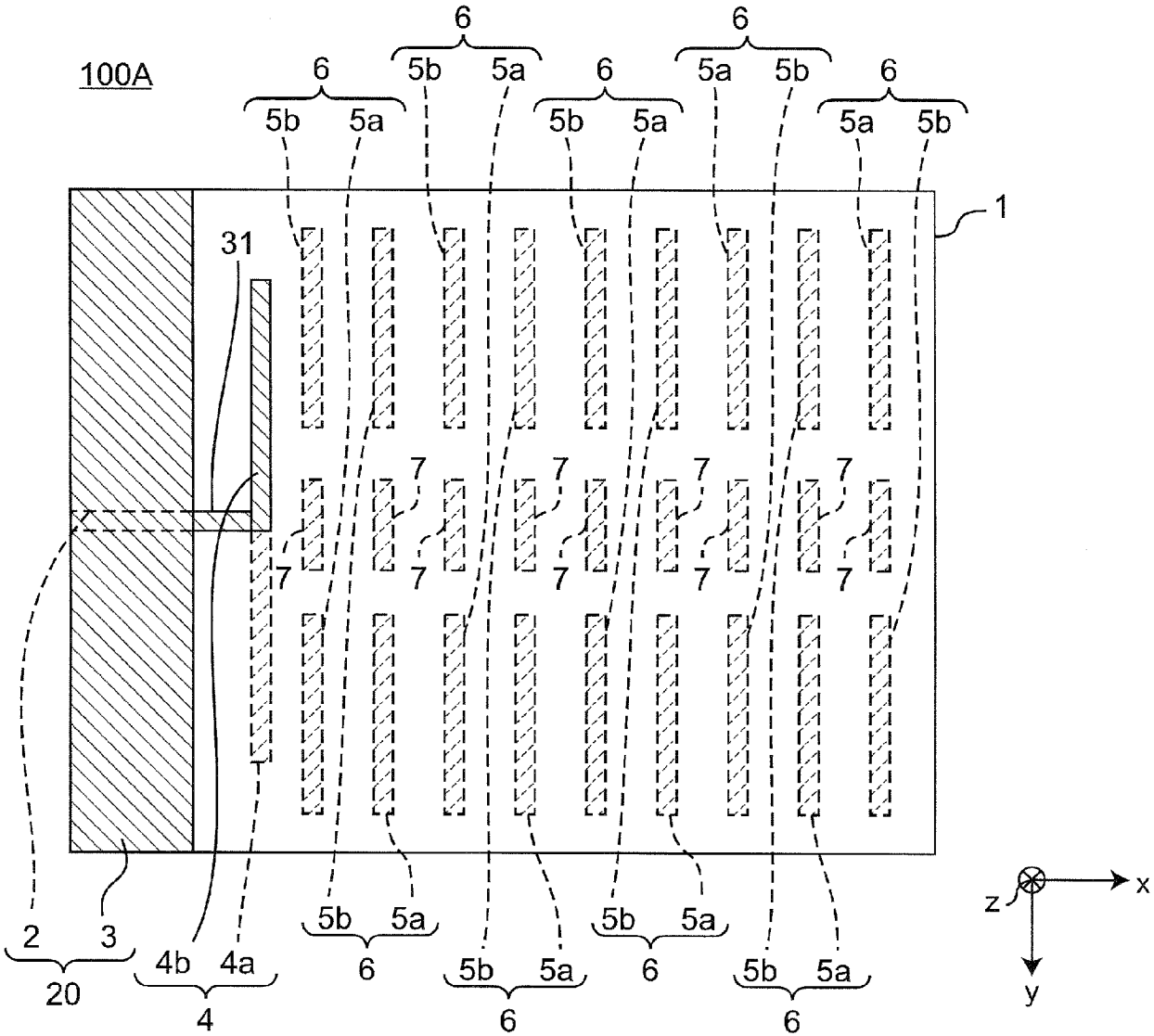
FIG. 7 is a reverse side view of the antenna apparatus 100A of FIG. 6.

FIG. 6 is a top view of the antenna apparatus 100A according to a second embodiment of the present invention, and FIG. 7 is a reverse side view of the antenna apparatus 100A of FIG. 6. Referring to FIGS. 6 and 7, the antenna apparatus 100A is characterized in that nine parasitic element pairs 6 are provided instead of the six parasitic element pairs 6, and six parasitic elements 7 are provided at the gap 5*c* of each of the parasitic element pairs 6. In the present embodiment, only points of difference from the first embodiment is described.

Referring to FIG. 6, each parasitic element pair 6 is configured to include parasitic elements 5*a* and 5*b*. In addition, in each of the parasitic element pairs 6, each of the parasitic elements 5*a* and 5*b* has a strip shape having an electrical length L4. The parasitic elements 5*a* and 5*b* of each of the parasitic element pairs 6 are formed on a straight line parallel to the y axis so as to have a gap 5*c* of a predetermined interval L9. Further, each of the parasitic elements 7 has a strip shape having an electrical length L7 so as to extend in the y-axis direction, and is formed in each gap 5*c*. In this case, an interval between one end of the parasitic element 7 and the parasitic element 5*a* and an interval between another end of the parasitic element 7 and the parasitic element 5*b* are each set to an interval L8.

Referring to FIG. 6, it is noted that the electrical length L4 is set to an electrical length substantially equal to λ/4. In addition, the electrical length L7 is set equal to or shorter than, for example, one third of the electrical lengths L4 in order to prevent the parasitic element 7 from resonating with the parasitic elements 5*a* and 5*b*. Further, the interval L8 is set so that the parasitic element 7 and the parasitic element 5*a* are electromagnetically coupled to each other, and so that the parasitic element 7 and the parasitic element 5*b* are electromagnetically coupled to each other.

According to the present embodiment, the parasitic element 7 and the parasitic element 5*a* are electromagnetically coupled to each other, and the parasitic element 7 and the parasitic element 5*b* are electromagnetically coupled to each other. Therefore, even when the interval L9 of the gap 5*c* is wider than an interval required for electromagnetically coupling the parasitic element 5*a* with the parasitic element 5*b* directly, the parasitic elements 5*a* and 5*b* can be electromagnetically coupled to each other via the parasitic element 7. Therefore, the antenna size in the horizontal direction can be widened as compared with that of the antenna apparatus 100 of the first embodiment. Therefore, the width of the horizontal beam becomes smaller than that of the first embodiment, and the gain can be increased.

Third Embodiment

Figure 8:
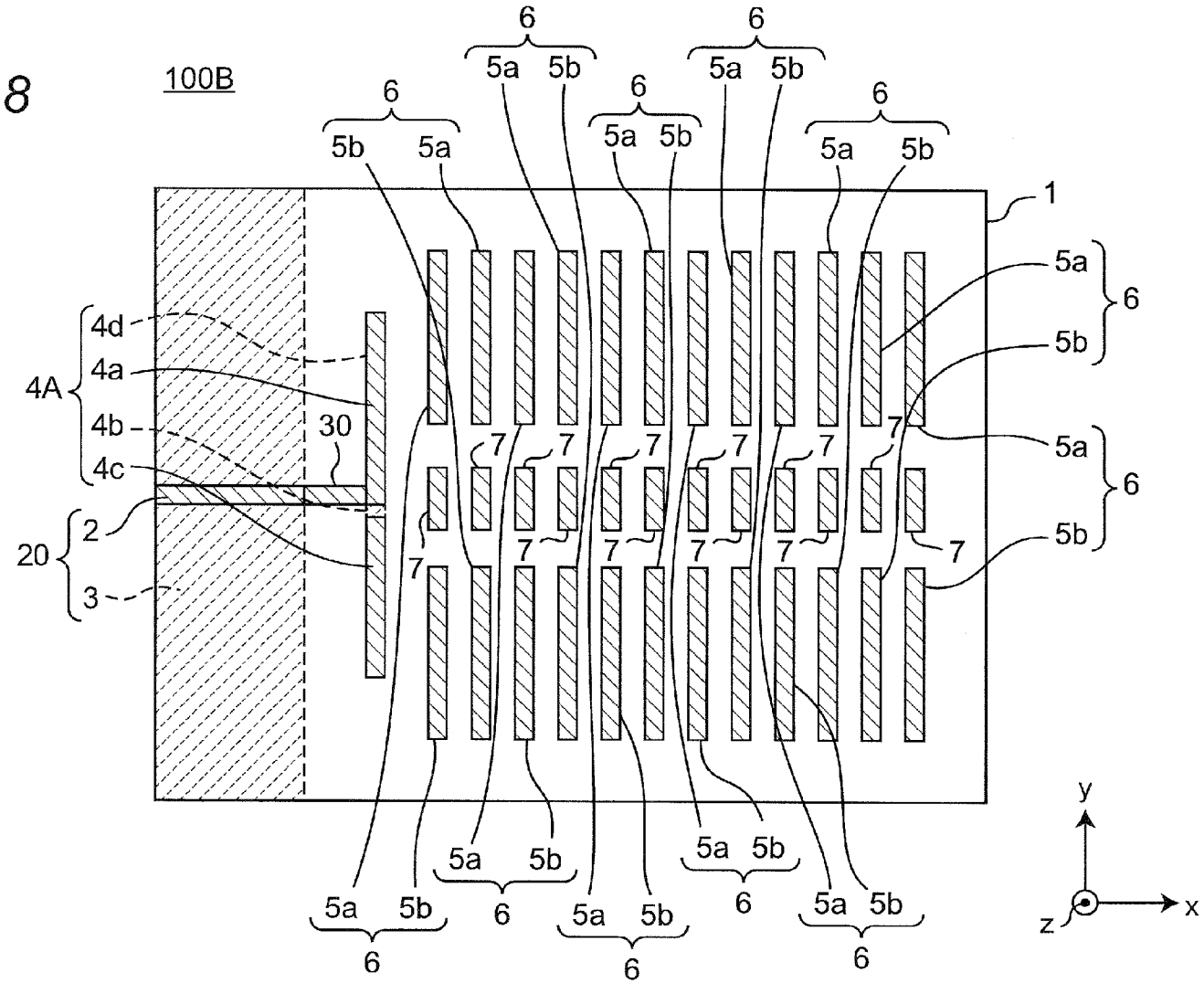
FIG. 8 is a top view of an antenna apparatus 100B according to a third embodiment of the present invention.
Figure 9:
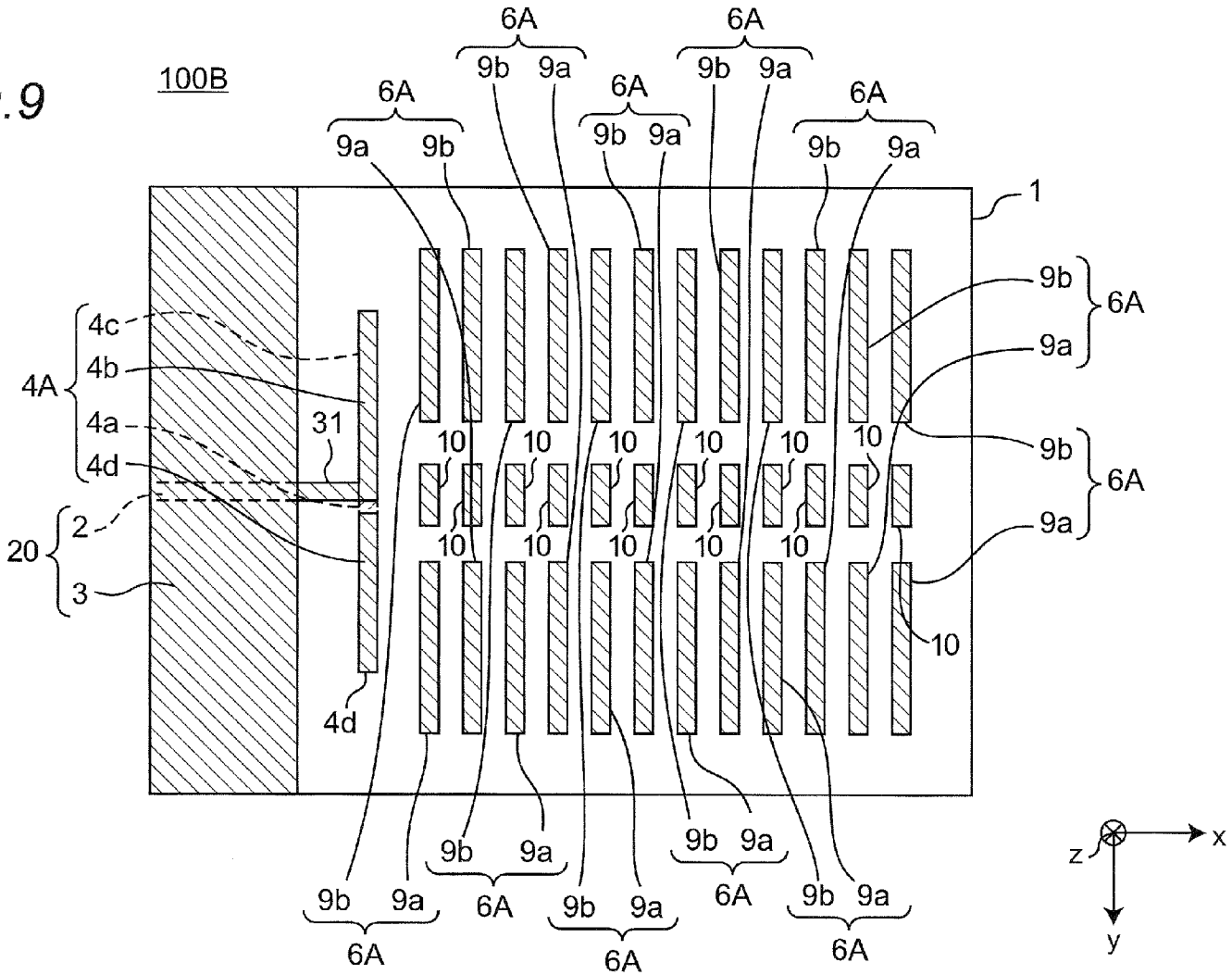
FIG. 9 is a reverse side view of the antenna apparatus 100B of FIG. 8.

FIG. 8 is a top view of an antenna apparatus 100B according to a third embodiment of the present invention, and FIG. 9 is a reverse side view of the antenna apparatus 100B of FIG. 8. The antenna apparatus 100B of the present embodiment is characterized in that a dipole antenna 4A is provided instead of the dipole antenna 4, and twelve parasitic element pairs 6A and twelve parasitic elements 10 are further provided as compared with the antenna apparatus 100A. In the present embodiment, only points of difference from the second embodiment is described.

Referring to FIGS. 8 and 9, the dipole antenna 4A is configured to include feed elements 4*a* and 4*b*, and parasitic elements 4*c* and 4*d*. In this case, the parasitic element 4*c* is formed on the reverse surface of the dielectric substrate 1 so as to oppose to the feed element 4*b* and so as to have a predetermined interval between the parasitic element 4*c* and the feed element 4*a*. In addition, the parasitic element 4*d* is formed on the reverse surface of the dielectric substrate 1 so as to oppose to the feed element 4*a* and so as to have a predetermined interval between the parasitic element 4*d* and the feed element 4*b*. Therefore, the parasitic element 4*c* is electromagnetically coupled to the feed element 4*b*, and the parasitic element 4*d* is electromagnetically coupled to the feed element 4*a*. Therefore, the dipole antenna 4A can radiate the radio wave more efficiently than the dipole antenna 4 of each of the above-described embodiments.

In addition, referring to FIGS. 8 and 9, each of the parasitic element pairs 6A is configured to include parasitic elements 9*a* and 9*b* formed on the reverse surface of the dielectric substrate 1. In addition, the parasitic elements 9*a* are formed to oppose to the parasitic elements 5*a*, respectively, and the parasitic elements 9*b* are formed to oppose to the parasitic element 5*b*, respectively. Further, the parasitic elements 10 are formed on the reverse surface of the dielectric substrate 1 to oppose to the parasitic elements 7, respectively. Therefore, in each of the parasitic element pairs 6A, the parasitic elements 9*b* and 10 are electromagnetically coupled to each other, and the parasitic elements 9*a* and 10 are electromagnetically coupled to each other. Further, the dipole antenna 4A and the parasitic element pairs 6A are opposing to each other and are electromagnetically coupled to each other.

According to the present embodiment, the parasitic elements 4*c* and 4*d*, the parasitic element pair 6A and the parasitic element 10 are further provided, and therefore, the radiation efficiency and the aperture efficiency can be increased as compared with each of the above-described embodiments.

Fourth Embodiment

Figure 10:
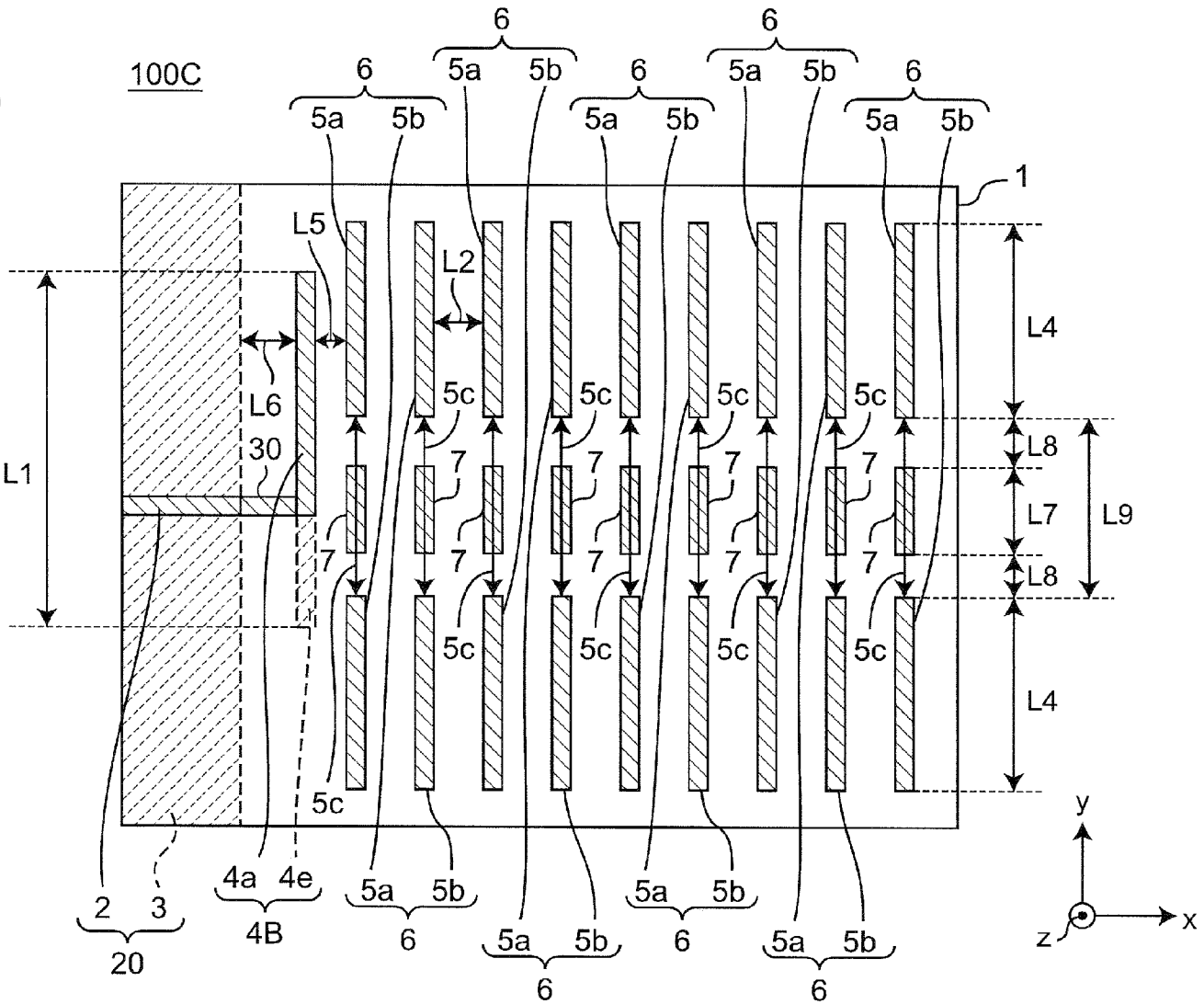
FIG. 10 is a top view of an antenna apparatus 100C according to a fourth embodiment of the present invention.
Figure 11:
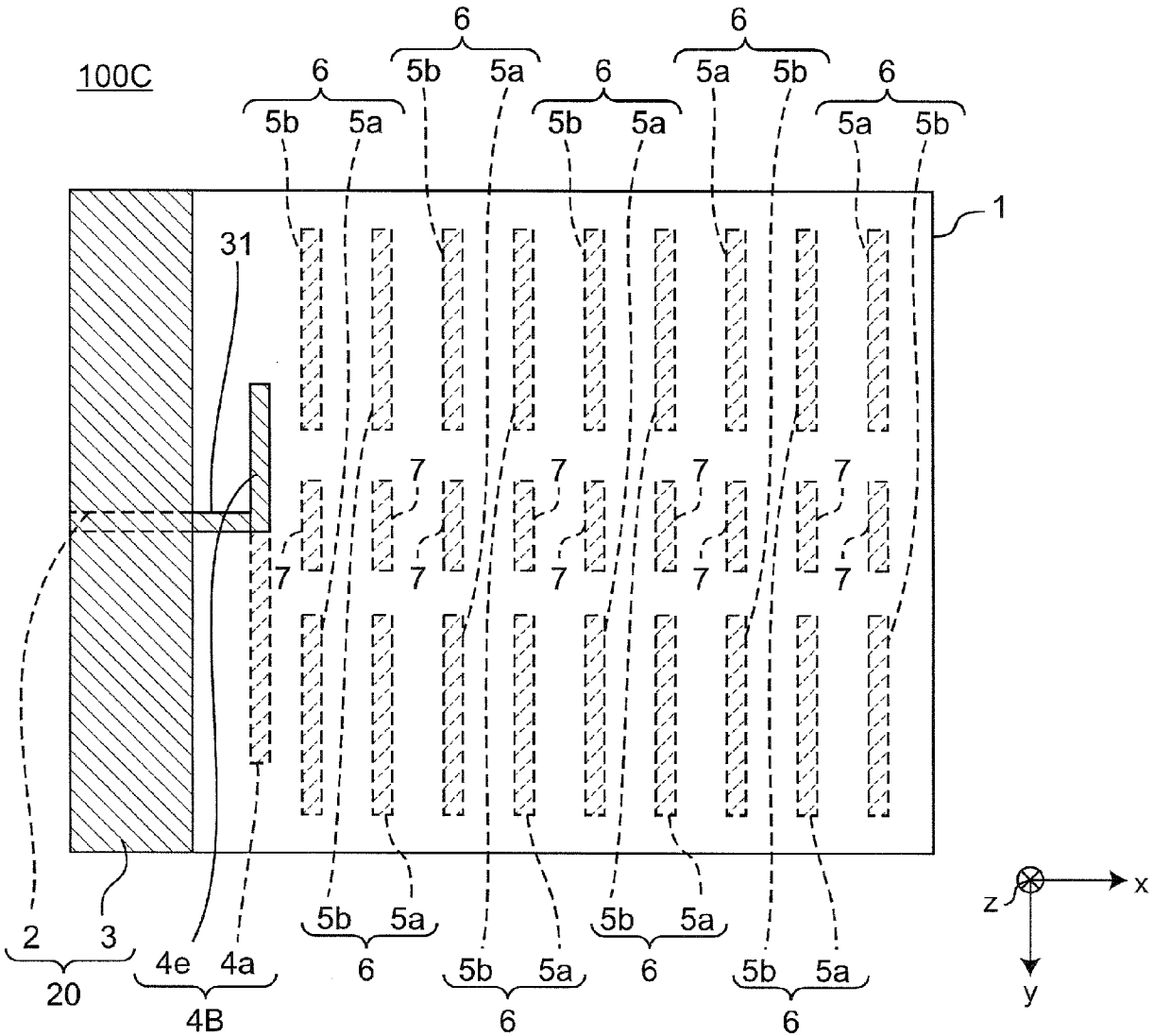
FIG. 11 is a reverse side view of the antenna apparatus 100C of FIG. 10.

FIG. 10 is a top view of an antenna apparatus 100C according to a fourth embodiment of the present invention, and FIG. 11 is a reverse side view of the antenna apparatus 100C of FIG. 10. The antenna apparatus 100C of the present embodiment is characterized in that a feed element 4*e* is provided instead of the feed element 4*b* as compared with the antenna apparatus 100A (See FIGS. 6 and 7) of the second embodiment. In the present embodiment, only points of difference from the second embodiment is described. In each of the above-described embodiments, the electrical lengths of the feed elements 4*a* and 4*b* are set to the values the same as each other. However, in the present embodiment, the electrical length of the feed element 4*e* is set to a value shorter than the electrical length of the feed element 4*b*. In addition, the feed elements 4*a* and 4*e* operate as a dipole antenna 4B that has an electrical length L1 from the open end of the feed element 4*a* to the open end of the feed element 4*e*.

Since the feeder line 20 is an unbalanced transmission line in the present embodiment and each of the above-described embodiments, when a balanced dipole antenna 4 is connected to the feeder line 20, it is sometimes the case where a current flowing through the feed element 4*a* and a current flowing through the feed element 4*b* become unbalanced and the beam on the horizontal plane is not directed to the end-fire direction. Since the antenna apparatuses 100, 100A and 100B of the above-described embodiments have a beam width smaller than that of the prior art, usability for the user becomes worse when the beam direction is not directed to in front of the antenna apparatuses 100, 100A and 100B.

In the antenna apparatus 100C of the present embodiment, by setting the electrical length of the feed element 4*e* shorter than the electrical length of the feed element 4*a*, the above-described unbalance of current is adjusted to allow the beam to be directed to the end-fire direction. In addition, since the radio wave from the dipole antenna 4B is directed to the end-fire direction, the waveguide efficiency in the parasitic element pairs 6 is more improved than in each of the above-described embodiments.

The electrical length of the feed element 4*e* is set shorter than the electrical length of the feed element 4*a*, however, the present invention is not limited to this. It is proper to set the electrical length of the feed element 4*a* and the electrical length of the feed element 4*e* to be different from each other so that the radiation direction of the radio wave from the dipole antenna 4B is directed to the end-fire direction.

In addition, the dipole antenna 4B may be provided instead of the dipole antenna 4 in the first embodiment. Further, in the third embodiment, the feed element 4*e* may be formed instead of the feed element 4*b* on the reverse surface of the dielectric substrate 1, and a parasitic element may be further formed on the reverse surface of the dielectric substrate 1 so as to oppose to the feed element 4*e* and so as to have a predetermined interval between the parasitic element and the feed elements 4*a*.

Fifth Embodiment

Figure 12:
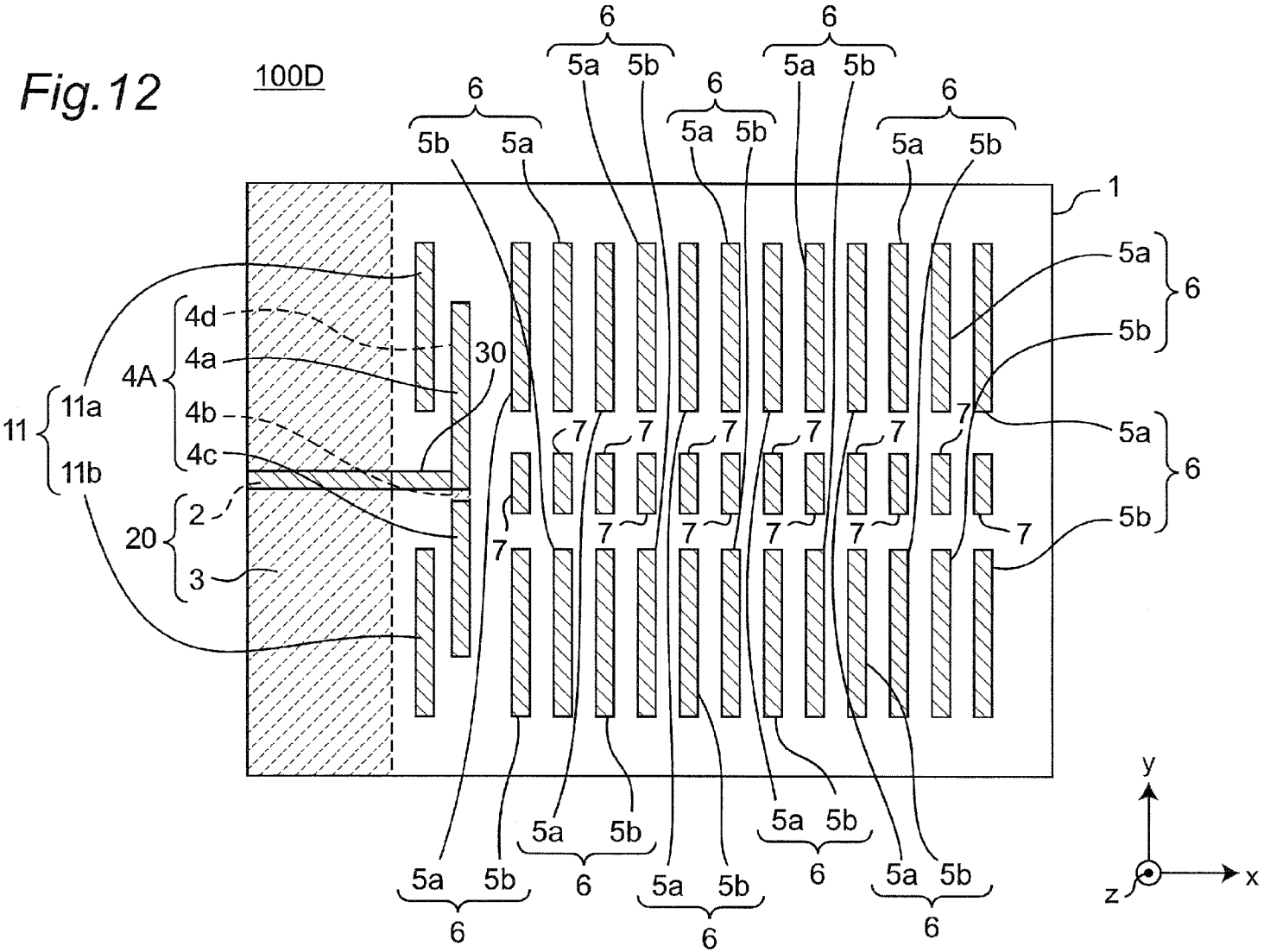
FIG. 12 is a top view of an antenna apparatus 100D according to a fifth embodiment of the present invention.
Figure 13:
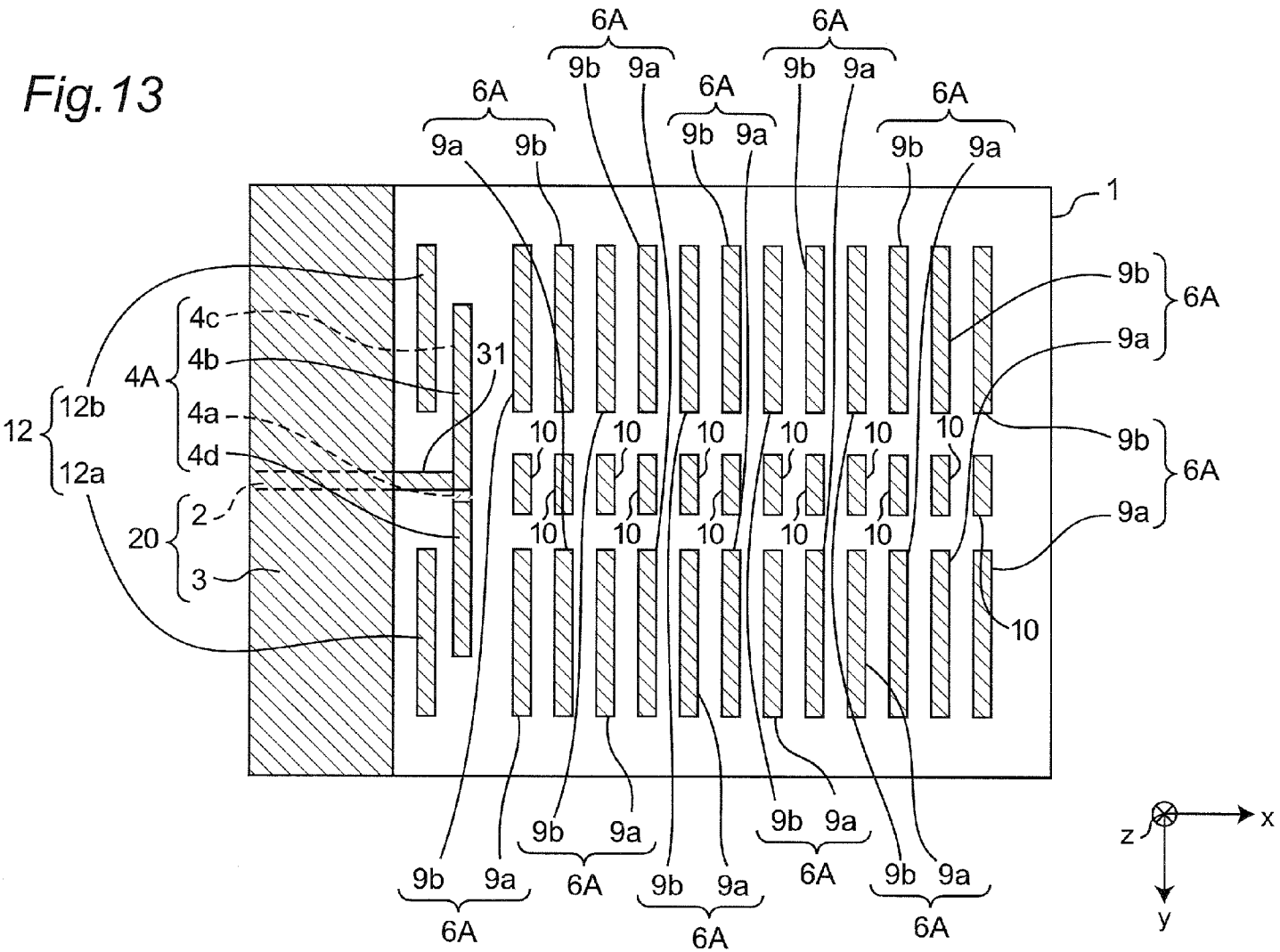
FIG. 13 is a reverse side view of the antenna apparatus 100D of FIG. 10.

FIG. 12 is a top view of an antenna apparatus 100D according to a fifth embodiment of the present invention, and FIG. 13 is a reverse side view of the antenna apparatus 100D of FIG. 10. The antenna apparatus 100D of the present embodiment is configured to further include a parasitic element pair 11 having parasitic elements 11*a* and 11*b*, and a parasitic element pair 12 having parasitic elements 12*a* and 12*b* as compared with the antenna apparatus 100B (See FIGS. 8 and 9) of the third embodiment. In the present embodiment, only points of difference from the third embodiment is described.

Referring to FIGS. 12 and 13, the parasitic elements 11*a* and 11*b* have a strip shape, and are formed on a straight line, which is parallel to the longitudinal direction of the dipole antenna 4A and is positioned in a direction opposite to the radiation direction of a radio wave from the dipole antenna 4A, so as to oppose to and to be electromagnetically coupled to the dipole antenna 4A. The parasitic elements 11*a* and 11*b* operate as a reflector. In addition, the parasitic elements 12*a* and 12*b* have a strip shape, and are formed on a straight line, which is parallel to the longitudinal direction of the dipole antenna 4A and is positioned in a direction opposite to the radiation direction of the radio wave from the dipole antenna 4A, so as to oppose to and to be electromagnetically coupled to the dipole antenna 4A. The parasitic elements 12*a* and 12*b* operate as a reflector.

In addition, referring to FIG. 12, the parasitic element 11*a* is formed on the reverse surface of the dielectric substrate 1 and in a region between the feed element 4*a* and the grounding conductor 3, so as to extend in the y-axis direction. In addition, the parasitic element 11*b* is formed on the reverse surface of the dielectric substrate 1 and in a region between the parasitic element 4*c* and the grounding conductor 3, so as to extend in the y-axis direction. Further, the parasitic elements 12*a* and 12*b* are formed to oppose to the parasitic elements 11*a* and 11*b*, respectively, on the reverse surface of the dielectric substrate 1. It is noted that each of the electrical lengths of the parasitic elements 11*a*, 11*b*, 12*a* and 12*b* is set to a value substantially equal to the electrical length L4 of the parasitic elements 5*a* and 5*b*. Preferably, the parasitic element pair 11 is provided so as to oppose to the parasitic element pairs 6. With this arrangement, the parasitic element 11*a* is electromagnetically coupled to the feed element 4*a*, the parasitic element 11*b* is electromagnetically coupled to the parasitic element 4*c*, the parasitic element 12*a* is electromagnetically coupled to the parasitic element 4*d*, and the parasitic element 12*b* is electromagnetically coupled to the feed element 4*b*.

According to the present embodiment, the parasitic element pairs 11 and 12 operating as the reflectors are provided in the positions on the opposite side in the radiation direction of the radio wave from the dipole antenna 4A with respect to the dipole antenna 4A. Therefore, the radio wave radiated from the dipole antenna 4 can be directed to the end-fire direction efficiently, and the FB (Front to Back) ratio can be improved as compared with the third embodiment. In particular, the effects of the parasitic elements 11*a*, 11*b*, 12*a* and 12*b* become larger as the antenna size in the horizontal direction of the antenna apparatus 100D is larger.

The antenna apparatus 100D has two parasitic element pairs 11 and 12, however, the present invention is not limited to this. Only one of the parasitic element pairs 11 and 12 may be provided. In addition, the electrical lengths of the feed elements 4*a* and 4*b* may be set so as to be different from each other to direct the main beam of the dipole antenna 4A to the end-fire direction.

In addition, at least one of the parasitic element pairs 11 and 12 may be provided with the antenna apparatuses 100, 100A, 100B and 100C.

Sixth Embodiment

Figure 14:
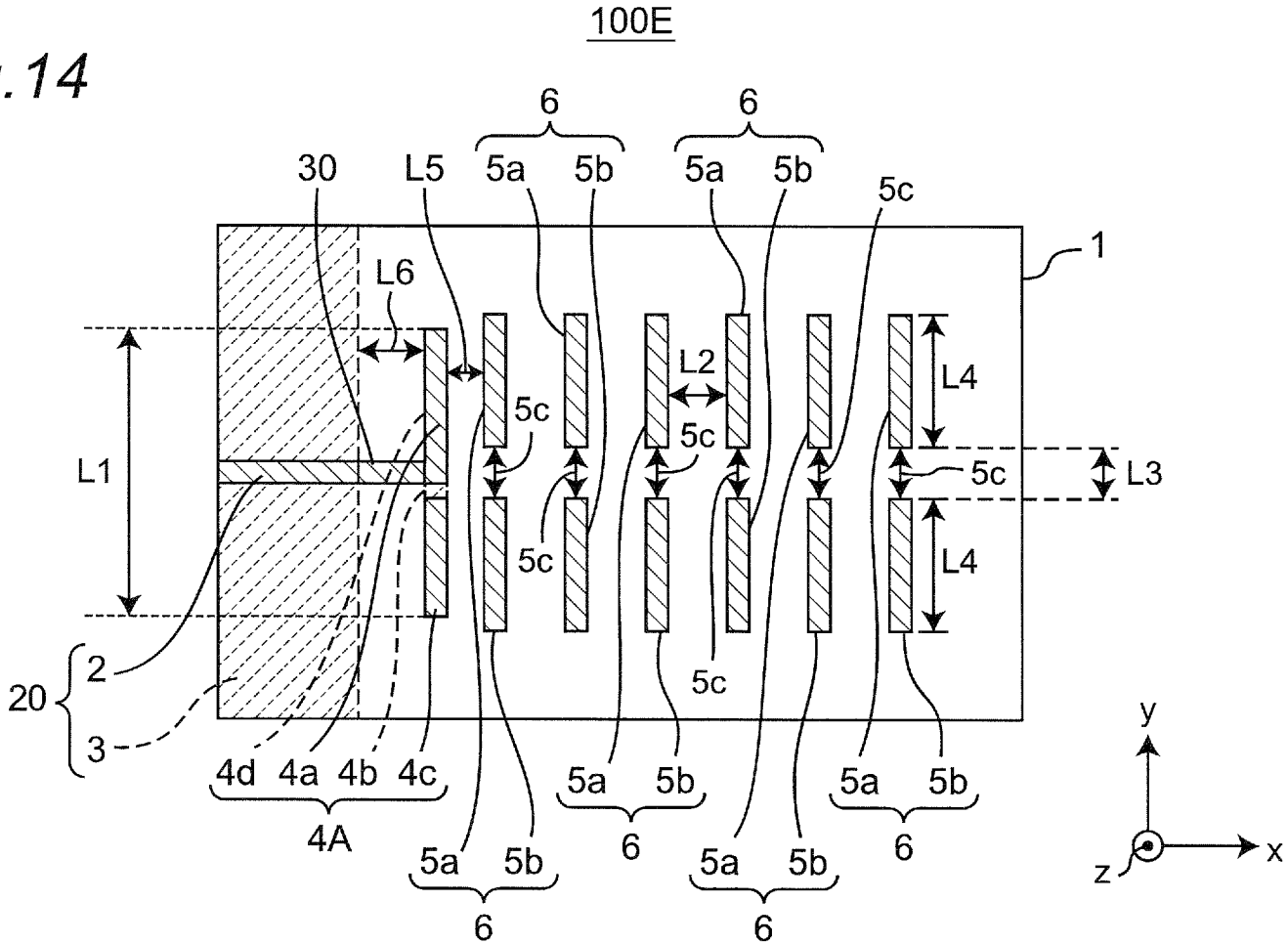
FIG. 14 is a top view of an antenna apparatus 100E according to a sixth embodiment of the present invention.
Figure 15:
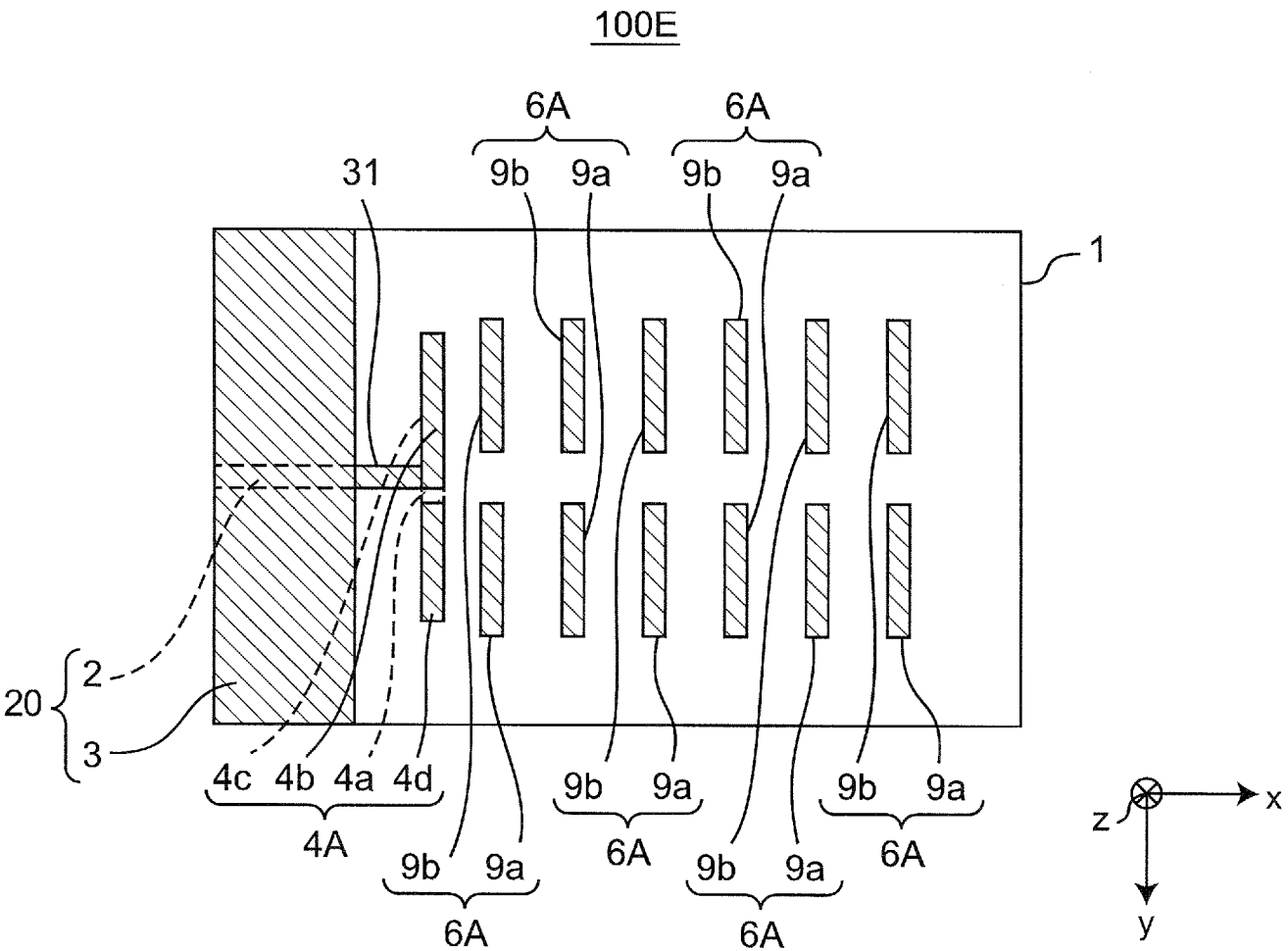
FIG. 15 is a reverse side view of the antenna apparatus 100E of FIG. 14.

FIG. 14 is a top view of an antenna apparatus 100E according to a sixth embodiment of the present invention, and FIG. 15 is a reverse side view of the antenna apparatus 100E of FIG. 14. The antenna apparatus 100E of the present embodiment is characterized in that a dipole antenna 4A is provided instead of the dipole antenna 4, and parasitic element pairs 6A opposing to the parasitic element pairs 6, respectively, are provided on the reverse surface of the dielectric substrate 1 as compared with the antenna apparatus 100 of the first embodiment. In this case, in the present embodiment, the dipole antenna 4A is configured in a manner similar to that of the dipole antenna 4A (See FIGS. 8 and 9) of the antenna apparatus 100B of the third embodiment. In addition, the parasitic elements 9*a* are formed to oppose to the parasitic elements 5*a*, respectively, and the parasitic elements 9*b* are formed to oppose to the parasitic elements 5*b*, respectively. Further, the parasitic elements 10 are formed on the reverse surface of the dielectric substrate 1 so as to oppose to the parasitic elements 7, respectively, Therefore, in each of the parasitic element pairs 6A, the parasitic elements 9*a* and 9*b* are electromagnetically coupled to each other. Further, the dipole antenna 4A and the parasitic element pairs 6A oppose to each other and are electromagnetically coupled to each other.

According to the present embodiment, the parasitic elements 4*c* and 4*d*, and the parasitic element pairs 6A are further provided, and therefore, the radiation efficiency and the aperture efficiency can be increased as compared with the first embodiment.

At least one of the parasitic element pairs 11 and 12 of the fifth embodiment may be provided with the antenna apparatus 100E of the present embodiment. In addition, the dipole antenna 4A or 4B may be provided with the antenna apparatus 100E instead of the dipole antenna 4. Further, the dipole antenna 4B may be provided instead of the dipole antenna 4A, and parasitic elements opposing to the parasitic elements 4*a* and 4*e*, respectively, may be further provided.

Seventh Embodiment

Figure 16:
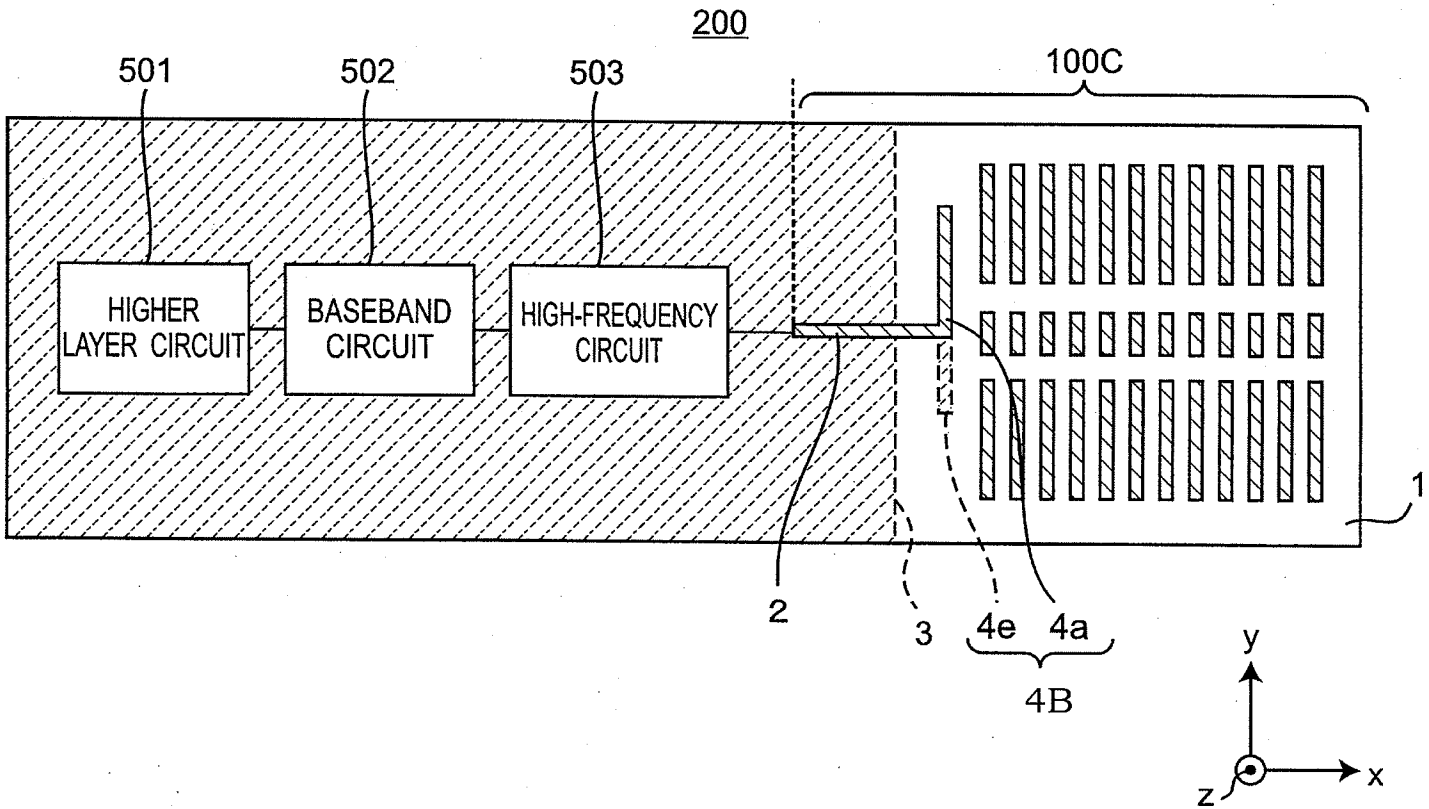
FIG. 16 is a top view of a wireless communication apparatus 200 according to a seventh embodiment of the present invention.

FIG. 16 is a top view of a wireless communication apparatus 200 according to a seventh embodiment of the present invention. Referring to FIG. 16, the wireless communication apparatus 200 is a wireless communication apparatus such as a wireless module board, and is configured to include the antenna apparatus 100C of the fourth embodiment, a higher layer circuit 501, a baseband circuit 502, and a high-frequency circuit 503. In this case, the higher layer circuit 501, the baseband circuit 502 and the high-frequency circuit 503 of the wireless communication apparatus 200 are provided on the top surface of the dielectric substrate 1, on which the strip conductor 2 is formed, and are provided at positions in a direction opposite to the radiation direction of the radio wave from the dipole antenna 4B with respect to the dipole antenna 4B.

Referring to FIG. 16, the higher layer circuit 501 is a circuit of a layer higher than the MAC (Media Access Control) layer and the physical layers of an application layer and the like, and includes a communication circuit and a host processing circuit, for example. The higher layer circuit 501 outputs a predetermined data signal to the baseband circuit 502, and executes predetermined signal processing for a baseband signal from the baseband circuit 502 so as to convert the baseband signal into a data signal. In addition, the baseband circuit 502 executes a waveform shaping process for the data signal from the higher layer circuit 501, and thereafter, modulates a predetermined carrier signal according to the processed data signal and outputs the resultant signal to the high-frequency circuit 503. Further, the baseband circuit 502 demodulates the high-frequency signal from the high-frequency circuit 503 into the baseband signal, and outputs the baseband signal to the higher layer circuit 501.

In addition, referring to FIG. 16, the high-frequency circuit 503 executes a power amplification process and a waveform shaping process for the high-frequency signal from the baseband circuit 502 in the radio-frequency band, and outputs the resultant signal to the dipole antenna 4B via the feeder line 2. Further, the high-frequency circuit 503 executes predetermined processing of frequency conversion and the like for the high-frequency signal wirelessly received by the dipole antenna 4B, and thereafter, outputs the resultant signal to the baseband circuit 502.

The high-frequency circuit 503 and the antenna apparatus 100C are connected to each other via a high-frequency transmission line. In addition, an impedance matching circuit is provided between the high-frequency circuit 503 and the antenna apparatus 100C when needed. The wireless communication apparatus 200 configured as described above wirelessly transmits and receives the high-frequency signal by using the antenna apparatus 100C, and therefore, it is possible to realize a wireless communication apparatus having a size smaller than that of the prior art and a gain higher than that of the prior art.

The wireless communication apparatus 200 of the present embodiment has the antenna apparatus 100C, however, the present invention is not limited to this, and the wireless communication apparatus 200 may have an antenna apparatus 100, 100A, 100B, 100D or 100E.

In addition, the microstrip line is used as the feeder line 20 for transmitting the high-frequency signal in each of the above-described embodiments, however, the present invention is not limited to this. An unbalanced transmission line such as a coplanar line or a balanced transmission line can be used as the feeder line 20.

The embodiments of the antenna apparatus and the wireless communication apparatus of the present invention have been described in detail above, however, the present invention is limited to none of the above-described embodiments. The embodiments may be variously improved or altered within a scope not departing from the substance of the present invention.

INDUSTRIAL APPLICABILITY

As described above, according to the antenna apparatus and the wireless communication apparatus of the present invention, there are provided a plurality of first parasitic element pairs, each of the first parasitic element pairs including first and second parasitic elements formed on the second surface. In this case, the first and second parasitic elements of each of the first parasitic element pairs have a strip shape and are formed on a straight line, which is parallel to a longitudinal direction of the dipole antenna and is positioned in a radiation direction of a radio wave from the dipole antenna, so as to have a gap therebetween and so as to be electromagnetically coupled with each other. In addition, the dipole antenna and the respective first parasitic element pairs are arranged at predetermined intervals so as to oppose to and to be electromagnetically coupled to each other. Therefore, it is possible to provide an antenna apparatus and a wireless communication apparatus each having a size smaller than that of the prior art and having a gain characteristic higher than that of the prior art.

REFERENCE SIGNS LIST

1 . . . dielectric substrate;
2, 30 and 31 . . . strip conductor;
3 . . . grounding conductor;
4, 4A and 4B . . . dipole antenna;
4*a*, 4*b* and 4*e* . . . feed element;
4*c*, 4*d*, 5*a*, 5*b*, 7, 9*a*, 9*b*, 10, 11*a*, 11*b*, 12*a* and 12*b* . . . parasitic element;
6, 6A, 11 and 12 . . . parasitic element pair;
20 . . . feeder line;
100, 100A, 100B, 100C, 100D and 100E . . . antenna apparatus; and
200 . . . wireless communication apparatus.

The invention claimed is:

1. An antenna apparatus comprising:
a dielectric substrate having first and second surfaces;
a grounding conductor formed on the first surface;
a strip conductor formed on the second surface so as to oppose to the grounding conductor to configure a feeder line;
a dipole antenna that comprises first and second feed elements and has an electrical length that is substantially a half of a wavelength of a high-frequency signal transmitted via the feeder line, the first feed element being formed on the second surface and connected to the strip conductor, the second feed element being formed on the first surface and connected to the grounding conductor; and
a plurality of first parasitic element pairs, each of the first parasitic element pairs comprising first and second parasitic elements being formed on the second surface,
wherein the first and second parasitic elements of each of the first parasitic element pairs have a strip shape and are formed on a straight line, which is parallel to a longitudinal direction of the dipole antenna and is positioned in a radiation direction of a radio wave from the dipole antenna, so as to have a gap therebetween and so as to be electromagnetically coupled with each other, and
wherein the dipole antenna and the respective first parasitic element pairs are arranged at predetermined intervals so as to oppose to and to be electromagnetically coupled to each other.

2. The antenna apparatus as claimed in claim 1 further comprising a plurality of third parasitic elements formed in the respective gaps between the first parasitic element pairs, respectively, so that each of the third parasitic elements is electromagnetically coupled to the first parasitic element and is electromagnetically coupled to the second parasitic element.

3. The antenna apparatus as claimed in claim 2,
wherein the dipole antenna further comprises:
a fourth parasitic element formed on the first surface so as to oppose to the first feed element; and
a fifth parasitic element formed on the second surface so as to oppose to the second feed element, and wherein the antenna apparatus further comprises:

a plurality of sixth parasitic elements formed on the first surface so as to oppose to the first parasitic elements, respectively;

a plurality of seventh parasitic elements formed on the first surface so as to oppose to the second parasitic elements, respectively; and a plurality of eighth parasitic elements formed on the first surface so as to oppose to the third parasitic elements, respectively.

4. The antenna apparatus as claimed in claim 1, wherein the dipole antenna further comprises:

a third parasitic element formed on the first surface so as to oppose to the first feed element; and a fourth parasitic element formed on the second surface so as to oppose to the second feed element, and wherein the antenna apparatus further comprises:

a plurality of fifth parasitic elements formed on the first surface so as to oppose to the first parasitic elements, respectively; and a plurality of sixth parasitic elements formed on the first surface so as to oppose to the second parasitic elements, respectively.

5. The antenna apparatus as claimed in claim 1, wherein an electrical length of the first feed element and an electrical length of the second feed element are set to be different from each other.

6. The antenna apparatus as claimed in claim 1, wherein an electrical length of the first feed element and an electrical length of the second feed element are set substantially equal to each other.

7. The antenna apparatus as claimed in claim 1, wherein the antenna apparatus further comprises at least one second parasitic element pair comprising two parasitic elements that are formed on one of the first and the second surfaces so as to operate as a reflector, and wherein the two parasitic elements have a strip shape and are formed on a straight line, which is parallel to the longitudinal direction of the dipole antenna and is positioned in a direction opposite to the radiation direction of the radio wave from the dipole antenna, so as to oppose to and electromagnetically coupled to the dipole antenna.

8. The antenna apparatus as claimed in claim 1, wherein the feeder line is an unbalanced line.

9. The antenna apparatus as claimed in claim 1, wherein the electrical length of each of the first parasitic elements and the electrical length of each of the second parasitic elements are set to an electrical length that is substantially one-fourth of the wavelength.

10. The antenna apparatus as claimed in claim 1, wherein the interval is set to an interval that is substantially equal to or smaller than one-eights of the wavelength.

11. A wireless communication apparatus comprising an antenna apparatus, wherein the antenna apparatus comprises:

a dielectric substrate having first and second surfaces;

a grounding conductor formed on the first surface;

a strip conductor formed on the second surface so as to oppose to the grounding conductor to configure a feeder line;

a dipole antenna that comprises first and second feed elements and has an electrical length that is substantially a half of a wavelength of a high-frequency signal transmitted via the feeder line, the first feed element being formed on the second surface and connected to the strip conductor, the second feed element being formed on the first surface and connected to the grounding conductor; and a plurality of first parasitic element pairs, each of the first parasitic element pairs comprising first and second parasitic elements formed on the second surface, wherein the first and second parasitic elements of each of the first parasitic element pairs have a strip shape and are formed on a straight line, which is parallel to a longitudinal direction of the dipole antenna and is positioned in a radiation direction of a radio wave from the dipole antenna, so as to have a gap therebetween and so as to be electromagnetically coupled with each other, and wherein the dipole antenna and the respective first parasitic element pairs are arranged at predetermined intervals so as to oppose to and to be electromagnetically coupled to each other.

* * * * *